US009387714B2

(12) United States Patent
Sugiyama et al.

(10) Patent No.: US 9,387,714 B2
(45) Date of Patent: Jul. 12, 2016

(54) MULTICOLOR THERMAL RECORDING MATERIAL, AND METHOD FOR COLOR FORMATION OF SAID MULTICOLOR THERMAL RECORDING MATERIAL

(71) Applicant: OJI HOLDINGS CORPORATION, Tokyo (JP)

(72) Inventors: Naonobu Sugiyama, Amagasaki (JP); Takashi Takemura, Amagasaki (JP)

(73) Assignee: OJI HOLDINGS CORPORATION, Tokyo (JP)

( * ) Notice: Subject to any disclaimer, the term of this patent is extended or adjusted under 35 U.S.C. 154(b) by 0 days.

(21) Appl. No.: 14/759,752

(22) PCT Filed: Dec. 25, 2013

(86) PCT No.: PCT/JP2013/084572

§ 371 (c)(1),
(2) Date: Jul. 8, 2015

(87) PCT Pub. No.: WO2014/109227

PCT Pub. Date: Jul. 17, 2014

(65) Prior Publication Data

US 2015/0343825 A1 Dec. 3, 2015

(30) Foreign Application Priority Data

Jan. 10, 2013 (JP) ..... 2013-002622

(51) Int. Cl.
*B41J 33/00* (2006.01)
*B41J 2/32* (2006.01)
(Continued)

(52) U.S. Cl.
CPC ... *B41M 5/28* (2013.01); *B41J 2/32* (2013.01); *B41M 5/30* (2013.01); *B41M 5/323* (2013.01); *B41M 5/34* (2013.01); *B41M 2205/04* (2013.01)

(58) Field of Classification Search
USPC ..... 347/171–176, 101, 103–106, 212–215, 347/217; 400/234, 235, 237
See application file for complete search history.

(56) References Cited

U.S. PATENT DOCUMENTS 3,843,384 A 10/1974 Addachi et al.
3,895,173 A 7/1975 Adachi
(Continued)

FOREIGN PATENT DOCUMENTS

JP 49-027708 B1 7/1974
JP 50-017865 B1 6/1975
(Continued)

*Primary Examiner* — Kristal Feggins
(74) *Attorney, Agent, or Firm* — Kratz, Quintos & Hanson, LLP

(57) ABSTRACT

A multicolor thermal recording material that allows multicolor printing in at least four colors and a method for developing color of the multicolor thermal recording material. The multicolor thermal recording material comprises (1) a support, (2) a first thermal color-developing layer containing a first dye precursor and a color-developing compound reactive with the first dye precursor under heating to develop the color of the first dye precursor, (3) an intermediate layer, (4) a second thermal color- developing layer containing composite fine particles containing a second dye precursor and a polymeric compound, and a color-developing compound reactive with the second dye precursor under heating, and (5) a third thermal color-developing layer containing composite fine particles containing a third dye precursor and a polymeric compound, and a color-developing compound reactive with the third dye precursor under heating; wherein the first, second, and third dye precursors are capable of developing mutually different colors.

9 Claims, 3 Drawing Sheets

(51) Int. Cl.

| | |
|---|---|
| ***B41M 5/28*** | (2006.01) |
| ***B41M 5/30*** | (2006.01) |
| ***B41M 5/323*** | (2006.01) |
| ***B41M 5/34*** | (2006.01) |

(56) References Cited

U.S. PATENT DOCUMENTS

| | | | |
|---|---|---|---|
| 4,644,376 | A | 2/1987 | Usami et al. |
| 5,558,700 | A | 9/1996 | Shibahashi et al. |
| 5,804,528 | A | 9/1998 | Aoki et al. |
| 2003/0125206 | A1 | 7/2003 | Bhatt et al. |
| 2004/0180284 | A1 | 9/2004 | Bhatt et al. |
| 2005/0052521 | A1 | 3/2005 | Bhatt et al. |
| 2006/0270552 | A1 | 11/2006 | Bhatt et al. |

FOREIGN PATENT DOCUMENTS

| | | | |
|---|---|---|---|
| JP | 51-019989 | B | 6/1976 |
| JP | 51-146239 | A | 12/1976 |
| JP | 56-099697 | A | 8/1981 |
| JP | 02-080287 | A | 3/1990 |
| JP | 04-004960 | B2 | 1/1992 |
| JP | 08-011467 | A | 1/1996 |
| JP | 08-127768 | A | 5/1996 |
| JP | 09-076634 | A | 3/1997 |
| JP | 09-290565 | A | 11/1997 |
| JP | 11-058983 | A | 3/1999 |
| JP | 2006-281475 | A | 10/2006 |
| JP | 2007-296718 | A | 11/2007 |
| JP | 4677431 | B2 | 4/2011 |

[A 1]

[A 2]

[B1]

[B 2]

[C 1]

[C 2]

[D 1]

[D 2]

MULTICOLOR THERMAL RECORDING MATERIAL, AND METHOD FOR COLOR FORMATION OF SAID MULTICOLOR THERMAL RECORDING MATERIAL

TECHNICAL FIELD

The present invention relates to a multicolor thermal recording material capable of developing different colors depending on differences in the conditions of applying heat from a thermal head, and to a method for developing color of the multicolor thermal recording material.

BACKGROUND ART

Conventionally well-known thermal recording materials use a coloring reaction of a dye precursor and a color developer that develops the color of the dye precursor upon contact with the dye precursor under heating, both coloring substances being melted and brought into contact with each other by heating, thereby obtaining colored images. Such thermal recording materials are relatively inexpensive, and require compact recording devices and easily maintenance of recording devices; therefore, they are used in a wide range of fields as recording media for facsimiles, word processors, various calculators, and other applications.

In accordance with the expansion of their applications, thermal recording materials are required to have various qualities, such as higher sensitivity, improved image stabilization, and multicolor recording capability.

Means of multicolor recording are advantageous in that, for example, letters and patterns to be emphasized can be markedly and clearly displayed in color different from other parts. In particular, multicolor thermal recording materials capable of recording in two or more colors from among red, blue, yellow, and black have excellent versatility, and their practical use is thus highly anticipated.

Attempts have been made to provide multicolor thermal recording materials that utilize the difference in heating temperature or heat energy, and various multicolor thermal recording materials have been proposed. Multicolor thermal recording materials generally comprise a high-temperature color-developing layer and a low-temperature color-developing layer that are sequentially laminated on a support and develop different colors. Such multicolor thermal recording materials are broadly classified into two types: decoloring materials and color-adding materials.

For example, PTL 1 to PTL 3 propose decoloring multicolor thermal recording materials in which a color-developing operation at a low temperature only develops the color of a low-temperature color-developing layer, and when a color-developing operation is performed at a high temperature, a decolorizing agent having a decoloring effect acts on the color-developing system of the low-temperature color-developing layer, and only the color of the high-temperature color-developing layer is obtained.

PTL 4 to PTL 6 propose color-adding multicolor thermal recording materials in which two thermal color-developing layers that develop different colors are laminated, and different amounts of heat are applied to thereby obtain two identifiable colors. Further, PTL 7 proposes a color-adding type multicolor thermal recording material in which two or more dye precursors developing different colors and having different average particle diameters are mixed in the same layer.

Moreover, PTL 8 proposes developing multiple colors by dissolving coloring components that develop mutually different colors in solvents, and encapsulating the resulting mixtures separately in two or more microcapsules having different glass transition temperatures.

In contrast, PTL 9 and PTL 10 propose multicolor thermal recording materials in which a dye precursor is formed into microcapsules or composite fine particles to thereby reduce its color-developing sensitivity, which is distinguished from the color-developing sensitivity of a dye precursor present in the form of solid fine particles, based on the difference in color-developing sensitivity.

However, such multicolor thermal recording materials had one or two color-developing layers, and it was possible to obtain only colored recording images in at most three colors (e.g., red, blue, and purple obtained by mixing red and blue).

In order to solve this problem, PTL 11 proposes a method for developing multiple colors by providing color-developing layers with three or more colors.

In the method of PTL 11, it is necessary to provide an intermediate layer between the thermal color-developing layers in order to control the temperature transmitted to each thermal color-developing layer. The formation of an intermediate layer between thermal color-developing layers causes problems of the increase in the number of times of coating during the production, and the reduction of the yield of each layer, consequently resulting in a significant cost increase. Moreover, dye precursors having different melting points are used in each color-developing layer in order to develop the color of each color-developing layer at a desired temperature; however, due to the restriction on the molecular structure of dye precursors, only limited dye precursors can be used, which results in problems in the selectivity of materials.

CITATION LIST

Patent Literature

PTL 1: JPS50-17865B
PTL 2: JPS57-14320B
PTL 3: JPH02-80287A
PTL 4: JPS49-27708B
PTL 5: JPS51-19989B
PTL 6: JPS51-146239A
PTL 7: JPS56-99697A
PTL 8: JPH04-4960B
PTL 9: JPH09-76634A
PTL 10: JPH09-290565A
PTL 11: JP4677431B

SUMMARY OF INVENTION

Technical Problem

An object of the present invention is particularly to provide a multicolor thermal recording material that allows multicolor printing in at least four colors depending on differences in the conditions of applying heat from a thermal head, and that is inexpensive and has excellent material selectivity, as well as providing a method for developing color of the multicolor thermal recording material.

Solution to Problem

The present invention relates to a multicolor thermal recording material comprising:

(1) a support; and in order from a side close to the support, (2) a first thermal color-developing layer containing a first dye precursor and a color-developing compound reactive with the first dye precursor under heating to develop the color of the first dye precursor;

(3) an intermediate layer;

(4) a second thermal color-developing layer containing a particle component containing a second dye precursor, and a color-developing compound reactive with the second dye precursor under heating to develop the color of the second dye precursor; and (5) a third thermal color-developing layer containing a particle component containing a third dye precursor, and a color-developing compound reactive with the third dye precursor under heating to develop the color of the third dye precursor;

wherein the first, second, and third dye precursors are capable of developing mutually different colors, the second dye precursor-containing particle component contained in the second thermal color-developing layer comprises composite fine particles containing the second dye precursor and a polymeric compound, and the third dye precursor-containing particle component contained in the third thermal color-developing layer comprises composite fine particles containing the third dye precursor and a polymeric compound.

In the multicolor thermal recording material of the present invention, the composite fine particles contained in the second and third thermal color-developing layers are preferably each obtained by emulsifying and dispersing a liquid composition containing a polyvalent isocyanate compound and the second or third dye precursor in water, followed by polymerization of the polyvalent isocyanate compound.

In the multicolor thermal recording material of the present invention, the first, second, and third thermal color-developing layers are preferably capable of developing mutually different colors, and each is capable of developing yellow, magenta, or cyan.

The multicolor thermal recording material of the present invention is preferably capable of developing yellow, blue, red, or black.

In the multicolor thermal recording material of the present invention, the dye precursor contained in the layer capable of developing yellow preferably has a pyridine skeleton in its molecular structure.

The present invention also relates to a method for developing color of the multicolor thermal recording material by application of heat from a thermal head.

In the method for developing color of the multicolor thermal recording material of the present invention, the first, second, and third thermal color-developing layers are preferably capable of developing mutually different colors, and each is capable of developing yellow, magenta, or cyan.

In the method for developing color of the multicolor thermal recording material of the present invention, the multicolor thermal recording material is capable of developing yellow, blue, red, or black.

In the method for developing color of the multicolor thermal recording material of the present invention, the color is preferably developed at a specific static color-development starting temperature adjusted by application of heat from the thermal head depending on one pulse width and pulse repeating frequency.

Advantageous Effects of Invention

The multicolor thermal recording material of the present invention allows multicolor printing in at least four colors depending on differences in the conditions of applying heat from a thermal head. In particular, when an intermediate layer is provided between the first and second thermal color-developing layers, the color of the first thermal color-developing layer can be singly developed by controlling the heating temperature of the thermal head, and can be separated from the color developed from the second thermal color-developing layer and/or the third thermal color-developing layer. When the second and third thermal color-developing layers are adjacent to each other, a mixed color can be immediately developed from the second and third thermal color-developing layers.

DESCRIPTION OF EMBODIMENTS

The present invention relates to a multicolor thermal recording material. The structure of the multicolor thermal recording material of the present invention is described below with reference to the drawings.

Figure 1:
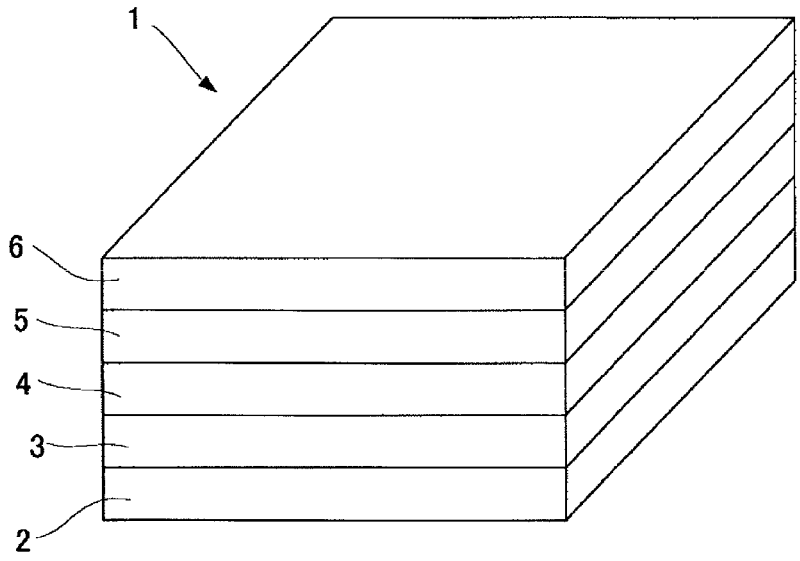
FIG. 1 schematically shows one embodiment of the multicolor thermal recording material of the present invention.

FIG. 1 schematically shows one embodiment of the multicolor thermal recording material of the present invention. The multicolor thermal recording material 1 of the present invention has a multilayer structure with at least three thermal color-developing layers, and comprises a support 2 and, in the order from the side close to the support 2, a first thermal color-developing layer 3, an intermediate layer 4, a second thermal color-developing layer 5, and a third thermal color-developing layer 6.

Of the thermal color-developing layers, the first thermal color-developing layer 3 contains a first dye precursor and a color-developing compound reactive with the first dye precursor under heating to develop the color of the first dye precursor; the second thermal color-developing layer 5 contains a particle component containing a second dye precursor, and a color-developing compound reactive with the second dye precursor under heating to develop the color of the second dye precursor; and the third thermal color-developing layer 6 contains a particle component containing a third dye precursor, and a color-developing compound reactive with the third dye precursor under heating to develop the color of the third dye precursor.

Depending on differences in the conditions of applying heat from a thermal head, the multicolor thermal recording material of the present invention allows color development from the first thermal color-developing layer (hereinafter also referred to as "single color 1"), color development from both first and second thermal color-developing layers (hereinafter also referred to as "mixed color 1"), color development from both second and third thermal color-developing layers (hereinafter also referred to as "mixed color 2"), and color development from the first, second, and third thermal color-developing layers (hereinafter also referred to as "mixed color 3"). A detailed description is provided below with reference to the drawings.

Single Color 1

Figure 2:
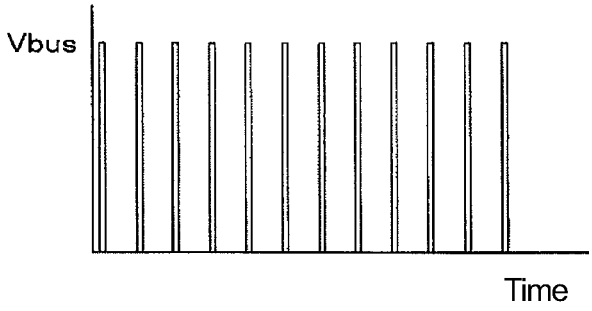
FIG. 2 schematically shows the development of the color (single color 1) from the first thermal color-developing layer by applying heat from a thermal head to the multicolor thermal recording material of the present invention. A1 (upper figure of FIG. 2) is a graph showing the conditions of applying energy from the thermal head, in which the horizontal axis represents the time, and the vertical axis represents the applied voltage ($V_{bus}$). A2 (lower figure of FIG. 2) shows the layer structure and colored part of the multicolor thermal recording material of the present invention. The arrow in A2 schematically shows the application of heat from the thermal head.
Figure 2:
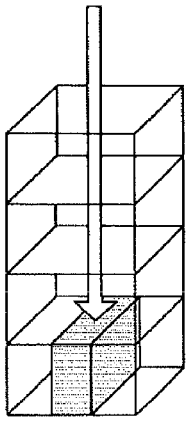

When the single color 1 of the multicolor thermal recording material of the present invention is developed, that is, when the color of the first thermal color-developing layer is developed, the conditions of applying energy from a thermal head are set so that the temperature is lower than the static color-development starting temperatures of the second and third thermal color-developing layers, and higher than the static color-development starting temperature of the first thermal color-developing layer. A specific example of the conditions of applying energy from the thermal head is shown in the condition A1 of FIG. 2, in which energy of the thermal head is repeatedly applied with a short pulse width for a long period of time at a constant applied voltage ($V_{bus}$) from the third thermal color-developing layer side of the multicolor thermal recording material of the present invention. The energy can thereby be applied at a low temperature for a long period of time, and the color of the first thermal color-developing layer can be developed without developing the colors of the second and third thermal color-developing layers (see A2 of FIG. 2).

The static color-development starting temperature mentioned herein refers to a temperature at which coloring is started when a hot plate at a predetermined temperature is pressed to a monochromatic thermal recording material using a single dye precursor for a certain period of time at a constant pressure.

The specific conditions of applying energy from the thermal head to develop the single color 1 can be suitably determined depending on the thickness of each layer constituting the multicolor thermal recording material, the type of component contained in each layer, etc. For example, when the head density of the thermal head is 203 dpi, printing is performed under the following conditions: one-line recording time is preferably about 4.93 to 492.61 msec/line, more preferably about 8.21 to 49.26 msec/line, and even more preferably about 8.21 to 20.0 msec/line; the energy applied per dot is preferably about 4.0 to 8.0 μJ/time, and more preferably about 4.8 to 7.8 μJ/time; one pulse cycle is preferably about 95 to 100 μsec, and more preferably about 96 to 99 μsec; and the pulse repeating frequency is preferably 80 to 160 times, and more preferably 100 to 140 times.

Mixed Color 1

Figure 3:
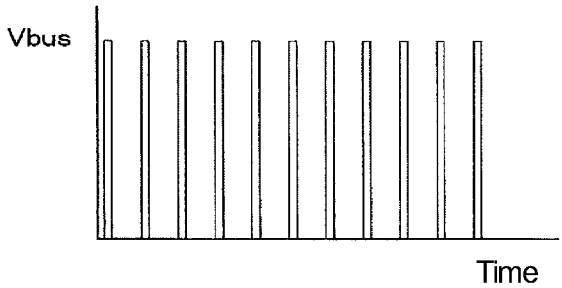
FIG. 3 schematically shows the development of the colors (mixed color 1) from the first and second thermal color-developing layers by applying heat from a thermal head to the multicolor thermal recording material of the present invention. B1 (upper figure of FIG. 3) is a graph showing the conditions of applying energy from the thermal head, in which the horizontal axis represents the time, and the vertical axis represents the applied voltage ($V_{bus}$). B2 (lower figure of FIG. 3) shows the layer structure and colored part of the multicolor thermal recording material of the present invention. The arrow in B2 schematically shows the application of heat from the thermal head.
Figure 3:
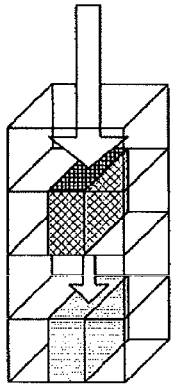

When the mixed color 1 of the multicolor thermal recording material of the present invention is developed, that is, when the colors developed from the first and second thermal color-developing layers are mixed, the conditions for applying energy from the thermal head are set so that the temperature is lower than the static color-development starting temperature of the third thermal color-developing layer and higher than the static color-development starting temperature of the second thermal color-developing layer. A specific example of the conditions of applying energy from the thermal head is shown in B1 of FIG. 3, in which energy of the thermal head is repeatedly applied at a constant applied voltage from the third thermal color-developing layer side with a pulse width longer than that for developing the color of the first thermal color-developing layer. Thus, the energy is applied at a medium temperature for a long period of time, and the colors of the first and second thermal color-developing layers can be developed without developing the color of the third thermal color-developing layer (see B2 of FIG. 3). The medium temperature mentioned herein refers to a temperature higher than the low temperature for the single color 1. Moreover, the long period of time means that the pulse repeating time is almost the same as for the single color 1.

The specific conditions of applying energy from the thermal head to develop the mixed color 1 can be suitably determined depending on the thickness of each layer constituting the multicolor thermal recording material, the type of component contained in each layer, etc. For example, when the head density of the thermal head is 203 dpi, printing is performed under the following conditions: one-line recording time is preferably about 4.93 to 492.61 msec/line, more preferably about 8.21 to 49.26 msec/line, and even more preferably about 8.21 to 20.0 msec/line; the energy applied per dot is preferably about 8.0 to 12.0 μJ/time, and more preferably about 8.8 to 11.2 μJ/time; one pulse cycle is preferably about 100 to 105 μsec, and more preferably about 101 to 104 μsec; and the pulse repeating frequency is preferably 80 to 150 times, and more preferably 100 to 130 times.

Mixed Color 2

Figure 4:
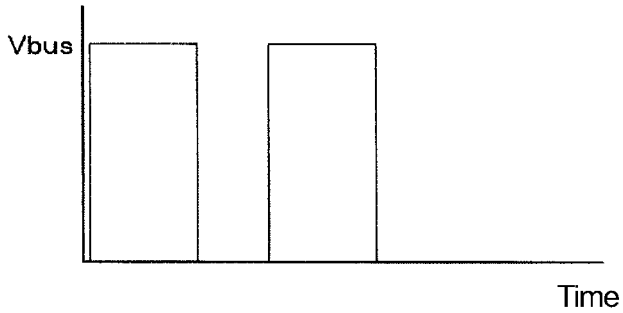
FIG. 4 schematically shows the development of the colors (mixed color 2) from the second and third thermal color-developing layers by applying heat from a thermal head to the multicolor thermal recording material of the present invention. C1 (upper figure of FIG. 4) is a graph showing the conditions of applying energy from the thermal head, in which the horizontal axis represents the time, and the vertical axis represents the applied voltage ($V_{bus}$). C2 (lower figure of FIG. 4) shows the layer structure and colored part of the multicolor thermal recording material of the present invention. The arrow in C2 schematically shows the application of heat from the thermal head.
Figure 4:
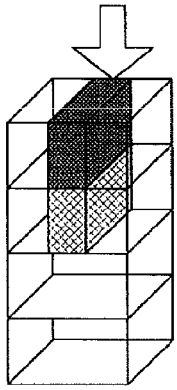

When the mixed color 2 of the multicolor thermal recording material of the present invention is developed, that is, when the colors developed from the second and third thermal color-developing layers are mixed, the conditions of applying energy from the thermal head are set so that the temperature is higher than the static color-development starting temperature of the third thermal color-developing layer, and so that the color development of the first thermal color-developing layer is prevented. A specific example of the conditions of applying energy from the thermal head is shown in C1 of FIG. 4, in which energy of the thermal head is repeatedly applied at a constant applied voltage from the third thermal color-developing layer side with a pulse width longer than that for developing the colors of the first and second thermal color-developing layers to obtain a mixed color, by repeatedly applying pluses fewer times than that for developing the colors of the first and second thermal color-developing layers to obtain a mixed color, or by applying a single pulse. Thus, the energy is applied at a high temperature for a short period of time, and the color of the second thermal color-developing layer can be developed while developing the color of the third thermal color-developing layer (see C2 of FIG. 4). The high temperature mentioned herein refers to a temperature higher than the medium temperature for the mixed color 1. Moreover, the short period of time means that the pulse repeating time is shorter than that for the mixed color 1, or that when a single pulse is applied, the pulse width is shorter than the pulse repeating time for the mixed color 1.

The specific conditions of applying energy from the thermal head to develop the mixed color 2 can be suitably determined depending on the thickness of each layer constituting the multicolor thermal recording material, the type of component contained in each layer, etc. For example, when the head density of the thermal head is 203 dpi, printing is performed under the following conditions: one-line recording time is preferably about 4.93 to 492.61 msec/line, more preferably about 8.21 to 49.26 msec/line, and even more preferably about 8.21 to 20.0 msec/line; the energy applied per dot is preferably about 32.0 to 799.0 μJ/time, more preferably about 63.9 to 639.2 μJ/time, and even more preferably about 300.0 to 639.2 μJ/time; one pulse cycle is preferably about 80 to 1,000 μsec, and more preferably about 160 to 800 μsec; and the pulse repeating frequency is preferably 1 to times, more preferably 1 to 10 times, and even more preferably to 3 times.

Mixed Color 3

Figure 5:
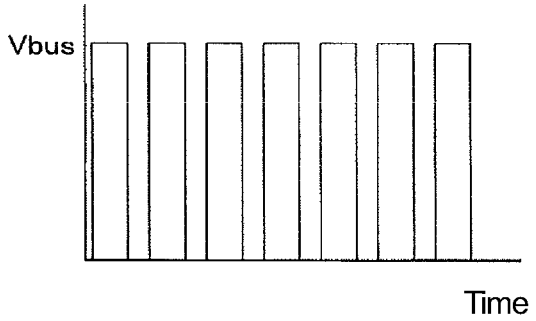
FIG. 5 schematically shows the development of the colors (mixed color 3) from the first, second, and third thermal color-developing layers by applying heat from a thermal head to the multicolor thermal recording material of the present invention. D1 (upper figure of FIG. 5) is a graph showing the conditions of applying energy from the thermal head, in which the horizontal axis represents the time, and the vertical axis represents the applied voltage ($V_{bus}$). D2 (lower figure of FIG. 5) shows the layer structure and colored part of the multicolor thermal recording material of the present invention. The arrow in D2 schematically shows the application of heat from the thermal head.
Figure 5:
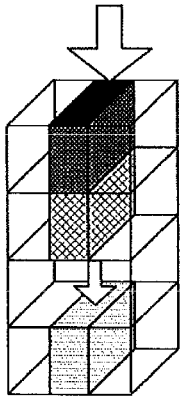

When the mixed color 3 of the multicolor thermal recording material of the present invention is developed, that is, when the colors developed from the first, second, and third thermal color-developing layers are mixed, the conditions for applying energy from the thermal head are set so that the temperature is higher than the static color-development starting temperature of the third thermal color-developing layer. A specific example of the conditions of applying energy from the thermal head is shown in D1 of FIG. 5, in which energy of the thermal head is applied at a constant applied voltage from the third thermal color-developing layer side at a high temperature for a long period of time, while the pulse width is adjusted to be shorter than that for obtaining the mixed color 2, and the pulse repeating frequency is adjusted to be grater than that for obtaining the mixed color 2. Thus, energy sufficient to develop the colors of all of the color-developing layers is applied. Under such applied energy conditions, the influence of heat damage that causes uneven luster, print burning, etc., on the recording surface can be reduced, and the colors of the first, second, and third thermal color-developing layers can be developed to obtain a mixed color (see D2 of FIG. 5). The high temperature mentioned herein refers to a temperature that is almost the same as the temperature for the mixed color 2. Moreover, the long period of time means that the pulse repeating time is longer than that for the mixed color 2, or that when a single pulse is applied, the pulse width is longer than that for the mixed color 2.

The specific conditions of applying energy from the thermal head to develop the mixed color 3 can be suitably determined depending on the thickness of each layer constituting the multicolor thermal recording material, the type of component contained in each layer, etc. For example, when the head density of the thermal head is 203 dpi, printing is performed under the following conditions: one-line recording time is preferably about 4.93 to 492.61 msec/line, more preferably about 8.21 to 49.26 msec/line, and even more preferably about 8.21 to 20.0 msec/line; the energy applied per dot is preferably about 16.0 to 319.6 μJ/time, more preferably about 32.0 to 255.7 μJ/time, and even more preferably about 32.0 to 100.0 μJ/time; one pulse cycle is preferably about 40 to 800 μsec, more preferably about 80 to 640 μsec, and even more preferably about 80 to 300 μsec; and the pulse repeating frequency is preferably 20 to 50 times, and more preferably 20 to 30 times.

The dye precursor-containing particle components contained in the second and third thermal color-developing layers are composite fine particles containing a dye precursor and a polymeric compound. The composite fine particles are preferably each obtained by emulsifying and dispersing a liquid composition containing a polyvalent isocyanate compound and a second or third dye precursor in water, followed by polymerization of the polyvalent isocyanate compound.

The static color-development starting temperatures of the second and third thermal color-developing layers depend on the polymeric characteristics of the composite fine particles and the color-developing compounds, and can therefore be easily controlled. Moreover, the same control is also possible when a plurality of dye precursors are used in combination to obtain a desired color; therefore, the static color-development starting temperatures are not restricted by the type of dye precursors. For example, the color-developing compound may be selected or the composite fine particles in the second thermal color-developing layer may be prepared so that the static color-development starting temperature of the second thermal color-developing layer is higher than the static color-development starting temperature of the first thermal color-developing layer and lower than the static color-development starting temperature of the third thermal color-developing layer. Further, the color-developing compound may be selected or the composite fine particles in the third thermal color-developing layer may be prepared so that the static color-development starting temperature of the third thermal color-developing layer is higher than the static color-development starting temperatures of the first and second thermal color-developing layers.

In the present invention, the polymeric characteristics of the composite fine particles can be controlled by the composition and the production conditions of the composite fine particles, (e.g., polyvalent isocyanate compound used, and the reaction accelerator).

In the present invention, an intermediate layer is not required between the second and third thermal color-developing layers. Therefore, an excellent multicolor thermal recording material can be obtained in a few steps. Because these layers are adjacent to each other, the mixed color 2 can be immediately developed, and color separation can be facilitated.

In the multicolor thermal recording material of the present invention, an intermediate layer is present between the first and second thermal color-developing layers. When an intermediate layer is provided between the first and second thermal color-developing layers, the development of the single color 1, mixed color 1, and mixed color 2 can be easily separated. Furthermore, when the mixed color 2 is developed, the color development from the first thermal color-developing layer can be prevented. Specifically, for example, when the first thermal color-developing layer is capable of developing yellow, and the mixed color 2 is blue, the color development from the first thermal color-developing layer can be prevented by providing an intermediate layer between the first and second thermal color-developing layers, thereby preventing the mixed color 2 from becoming greenish to blackish.

In the present invention, for example, the difference in static color-development starting temperature between the second and first thermal color-developing layers is not particularly limited, but is preferably 30° C. or more. When the difference in static color-development starting temperature between the second and first thermal color-developing layers is 30° C. or more, the development of the single color 1 and the mixed color 1 can be more easily separated. On the other hand, the difference in static color-development starting temperature is preferably 60° C. or less. This enables immediate development of the mixed color 1, thereby facilitating color separation from the mixed color 2.

As described above, when the multicolor thermal recording material of the present invention is used, mutually different colors can be developed depending on differences in the conditions of applying heat from a thermal head. That is, the color developed at a low temperature for a long period of time results from the reaction of the first dye precursor and a color-developing compound present in the first thermal color-developing layer. The color developed at a medium temperature for a long period of time is a mixture of a color resulting from the reaction of the first dye precursor and a color-developing compound in the first thermal color-developing layer, and a color resulting from the reaction of the second dye precursor present in the composite fine particles and a color-developing compound in the second thermal color-developing layer. The color developed at a high temperature for a short period of time is a mixture of a color resulting from the reaction of the second dye precursor present in the composite fine particles and a color-developing compound in the second thermal color-developing layer, and a color resulting from the reaction of the third dye precursor present in the composite fine particles and a color-developing compound in the third thermal color-developing layer. The color developed at a high temperature for a long period of time is a mixture of a color resulting from the reaction of the first dye precursor and a color-developing compound in the first thermal color-developing layer, a color resulting from the reaction of the second dye precursor present in the composite fine particles and a color-developing compound in the second thermal color-developing layer, and a color resulting from the reaction of the third dye precursor present in the composite fine particles and a color-developing compound in the third thermal color-developing layer.

Dye precursors described below can be used as the dye precursors that can be contained in the first, second, and third thermal color-developing layers of the present invention. Triaryl, diphenylmethane, thiazine, spiro, lactam, fluoran, and like leuco compounds can be preferably used. Such dye precursors provide their unique colors upon contact with color-developing compounds. The colors of the dye precursors cover a wide range, including black, red, magenta, blue, cyan, green, and yellow. For the combination of the first, second, and third thermal color-developing layers, dye precursors that develop mutually different colors may be selected.

In the present invention, it is preferable that the first, second, and third thermal color-developing layers are capable of developing mutually different colors, and each is capable of developing yellow, magenta, or cyan. This results in a vivid color by mixing two or more colors.

In particular, when the red coloring system is a color mixture of magenta and yellow, and the blue coloring system is a color mixture of cyan and magenta, the four colors blue, red, yellow, and black can be developed with the three colors yellow, magenta, and cyan. Thus, they are preferable as the colors of the present invention. In order to obtain such colors, it is preferable that the first dye precursor contained in the first thermal color-developing layer, the second dye precursor contained in the second thermal color-developing layer, and the third dye precursor contained in the third thermal color-developing layer are capable of developing yellow, magenta, or cyan. It is more preferable that the first dye precursor is capable of developing yellow, the second dye precursor is capable of developing magenta, and the third dye precursor is capable of developing cyan.

By combining the colors of the dye precursors, yellow can be obtained from the single color 1, red can be obtained from the mixed color 1 (color mixture of yellow and magenta), blue can be obtained from the mixed color 2 (color mixture of magenta and cyan), and black can be obtained from the mixed color 3 (color mixture of yellow, magenta, and cyan).

In the present invention, when different colors are developed by applying heat from a thermal head depending on one pulse width and pulse repeating frequency, for example, in the above combination, the one pulse width is adjusted to become shorter in order from the longest width for the mixed color 2 to the mixed color 3, mixed color 1, and single color 1, and the pulse repeating frequency is adjusted to be greater for the single color 1 and mixed color 1, and to be reduced in order of the mixed color 3 and mixed color 2. Thus, adjacent dots can be developed into different colors selected from at least four colors by one scanning of the thermal head. As a result, recording with excellent visibility can be performed by developing the color of letters and patterns to be emphasized, different from the color of other parts, without scanning of the thermal head several times for every time each color is obtained. Moreover, the printer mechanism can be simplified, and the time required for recording can be shortened.

The components contained in each layer of the multicolor thermal recording material of the present invention are described in more detail below.

(1) Support

The type, shape, size, etc., of the support used in the present invention are not particularly limited. For example, the support can be suitably selected from fine-quality paper (acid paper, alkaline paper), medium-quality paper, coated paper, art paper, cast-coated paper, glassine paper, resin-laminated paper, polyolefin-based synthetic paper, synthetic fiber paper, non-woven fabric, synthetic resin films, and the like, as well as various transparent supports. When the present invention is used for the purpose of magnetic tickets, paper is preferably used. When the present invention is used for the purpose of prepaid cards or magnetic season tickets, plastics substrates comprising polyethylene terephthalate having a thickness of 100 μm or more, particularly foamed substrates, are preferably used in terms of thermal color-developing sensitivity. Of course, a laminate substrate of a foamed polyethylene terephthalate film and a non-foamed polyethylene terephthalate film can also be used.

(2) First Thermal Color-Developing Layer

In the multicolor thermal recording material of the present invention, the first thermal color-developing layer contains a first dye precursor and a color-developing compound reactive with the first dye precursor under heating to develop the color of the first dye precursor. The first dye precursor is not limited to a single compound. Two or more dye precursors developing different colors can be mixed to achieve a desired color.

Examples of dye precursors developing black that can be used as the first dye precursor include 3-pyrrolidino-6-methyl-7-anilinofluoran, 3-diethylamino-7-(m-trifluoromethylanilino)fluoran, 3-diethylamino-6-methyl-7-(m-methylanilino)fluoran, 3-(N-isoamyl-N-ethylamino)-7-(o-chloroanilino)fluoran, 3-(N-ethyl-p-toluidino)-6-methyl-7-anilinofluoran, 3-(N-ethyl-N-2-tetrahydrofurfurylamino)-6-methyl-7-anilinofluoran, 3-diethylamino-6-chloro-7-anilinofluoran, 3-di(n-butyl)amino-6-methyl-7-anilinofluoran, 3-di(n-amyl)amino-6-methyl-7-anilinofluoran, 3-(N-isoamyl-N-ethylamino)-6-methyl-7-anilinofluoran, 3-(N-n-hexyl-N-ethylamino)-6-methyl-7-anilinofluoran, 3-[N-(3-ethoxypropyl)-N-ethylamino]-6-methyl-7-anilinofluoran, 3-[N-(3-ethoxypropyl)-N-methylamino]-6-methyl-7-anilinofluoran, 3-diethylamino-7-(2-chloroanilino)fluoran, 3-di(n-butyl)amino-7-(2-chloroanilino)fluoran, 3-diethylamino-6-methyl-7-anilinofluoran, 3-diethylamino-6-methyl-7-(2,6-dimethylanilino)fluoran, 3-diethylamino-6-methyl-7-(2,4-dimethylanilino)fluoran, 2,4-dimethyl-6-(4-dimethylaminoanilino)fluoran, 3-(N-cyclohexyl-N-methylamino)-6-methyl-7-anilinofluoran, and the like.

Among the black-developing dye precursors, it is preferable to use at least one member selected from 3-di(n-amyl)amino-6-methyl-7-anilinofluoran, 3-diethylamino-6-methyl-7-(2,6-dimethylanilino)fluoran, 3-diethylamino-6-methyl-7-(2,4-dimethylanilino)fluoran, and 2,4-dimethyl-6-(4-dimethylaminoanilino)fluoran, all of which have relatively superior light resistance.

Examples of blue-developing dye precursors developing cyan that can be used as the first dye precursor include 3,3-bis(p-dimethylaminophenyl)-6-dimethylaminophthalide, 3-(4-diethylamino-2-methylphenyl)-3-(4-dimethylaminophenyl)-6-dimethylaminophthalide, 3-(4-diethylamino-2-ethoxyphenyl)-3-(1-ethyl-2-methylindol-3-yl)-4-azaphthalide, 3-(1-ethyl-2-methylindol-3-yl)-3-(4-diethylaminophenyl)phthalide, 3-(1-ethyl-2-methylindol-3-yl)-3-(2-methyl-4-diethylaminophenyl)-4-azaphthalide, 3-(1-ethyl-2-methylindol-3-yl)-3-(2-ethoxy-4-diethylaminophenyl)-4-azaphthalide, 3-(1-ethyl-2-methylindol-3-yl)-3-(2-n-hexyloxy-4-diethylaminophenyl)-4-azaphthalide, 3-diphenylamino-6-diphenylaminofluoran, and the like.

Examples of preferable dye precursors developing cyan that can be used as the first dye precursor include 3-(1-ethyl-2-methylindol-3-yl)-3-(4-diethylamino-2-methylphenyl)-4-azaphthalide, 3-[1,1-bis(p-diethylaminophenyl)ethylene-2-yl]-6-dimethylaminophthalide, 3,3'-bis(4-diethylamino-2-ethoxyphenyl)-4-azaphthalide, and the like.

Examples of dye precursors developing green that can be used as the first dye precursor include 3-(N-ethyl-N-n-hexylamino)-7-anilinofluoran, 3-diethylamino-7-dibenzylaminofluoran, 3,3-bis(4-diethylamino-2-ethoxyphenyl)-4-azaphthalide, 3-(N-ethyl-N-p-tolylamino)-7-(N-phenyl-N-methylamino)fluoran, 3-[p-(p-anilinoanilino)anilino]-6-methyl-7-chlorofluoran, 3,6-bis(dimethylamino)fluorene-9-spiro-3'-(6'-dimethylamino)phthalide, and the like.

Examples of dye precursors having absorption in the near-infrared region that can be used as the first dye precursor include 3,3-bis[1,1-bis(4-pyrrolidinophenyl)ethylene-2-yl]-4,5,6,7-tetrabromophthalide, 3,3-bis[1-(4-methoxyphenyl)-1-(4-dimethylaminophenyl)ethylene-2-yl]-4,5,6,7-tetrachlorophthalide, 3,3-bis[1-(4-methoxyphenyl)-1-(4-pyrrolidinophenyl)ethylene-2-yl]-4,5,6,7-tetrachlorophthalide, 3-[p-(p-anilinoanilino)anilino]-6-methyl-7-chlorofluoran, 3-[p-(p-dimethylaminoanilino)anilino]-6-methyl-7-chlorofluoran, 3,6-bis(dimethylamino)fluorene-9-spiro-3'-(6'-dimethylamino)phthalide, bis(p-dimethylaminostyryl)-p-tolylsulfonylmethane, 3-[p-(p-dimethylaminoanilino)anilino]-6-methylfluoran, 3-di(n-pentyl)amino-6,8,8-trimethyl-8,9-dihydro-(3,2,e)pyridofluoran, 3-di(n-butyl)amino-6,8,8-trimethyl-8,9-dihydro-(3,2,e)pyridofluoran, 3-(p-n-butylaminoanilino)-6-methyl-7-chlorofluoran, 2-mesidino-8-diethylamino-benz[C]fluoran, and the like.

Examples of red-developing dye precursors developing magenta that can be used as the first dye precursor include 3,6-bis(diethylamino)fluoran-γ-anilinolactam, 3,6-bis(diethylamino)fluoran-γ-(p-nitro)anilinolactam, 3,6-bis(diethylamino)fluoran-γ-(o-chloro)anilinolactam, 3-dimethylamino-7-bromofluoran, 3-diethylaminofluoran, 3-diethylamino-6-methylfluoran, 3-diethylamino-7-methylfluoran, 3-diethylamino-7-chlorofluoran, 3-diethylamino-7-bromofluoran, 3-diethylamino-7,8-benzofluoran, 3-diethylamino-6,8-dimethylfluoran, 3-diethylamino-6-methyl-7-chlorofluoran, 3-diethylamino-7-tert-butylfluoran, 3-(N-ethyl-N-tolylamino)-7-methylfluoran, 3-(N-ethyl-N-tolylamino)-7-ethylfluoran, 3-(N-ethyl-N-isobutylamino)-6-methyl-7-chlorofluoran, 3-(N-ethyl-N-isoamylamino)-7,8-benzofluoran, and the like.

Other examples include 3-cyclohexylamino-6-chlorofluoran, 3-di(n-butyl)amino-6-methyl-7-bromofluoran, 3-di(n-butyl)amino-7,8-benzofluoran, 3-tolylamino-7-methylfluoran, 3-tolylamino-7-ethylfluoran, 2-(N-acetylanilino)-3-methyl-6-di(n-butyl)aminofluoran, 2-(N-propionylanilino)-3-methyl-6-di(n-butyl)aminofluoran, 2-(N-benzoylanilino)-3-methyl-6-di(n-butyl)aminofluoran, 2-(N-carbobutoxyanilino)-3-methyl-6-di(n-butyl)aminofluoran, 2-(N-formylanilino)-3-methyl-6-di(n-butyl)aminofluoran, 2-(N-benzylanilino)-3-methyl-6-di(n-butyl)aminofluoran, 2-(N-allylanilino)-3-methyl-6-di(n-butyl)aminofluoran, 2-(N-methylanilino)-3-methyl-6-di(n-butyl)aminofluoran, 3-diethylamino-7-phenoxyfluoran, and the like.

Other examples of dye precursors developing magenta include 3,3'-bis(1-ethyl-2-methylindol-3-yl)phthalide, 3,3'-bis(1-n-octyl-2-methylindol-3-yl)phthalide, 7-(N-ethyl-N-isoamylamino)-3-methyl-1-phenylspiro[(1,4-dihydrochromeno[2,3-c]pyrazole)-4,3'-phthalide], 7-(N-ethyl-N-isoamylamino)-3-methyl-1-p-methylphenylspiro[(1,4-dihydrochromeno[2,3-c]pyrazole)-4,3'-phthalide], 7-(N-ethyl-N-n-hexylamino)-3-methyl-1-phenylspiro[(1,4-dihydrochromeno[2,3-c]pyrazole)-4,3'-phthalide], and the like. Examples of dye precursors developing magenta that can be used as the first dye precursor include 3-(N-ethyl-N-isoamylamino)-7,8-benzofluoran, 3,3'-bis(1-n-butyl-2-methylindol-3-yl)phthalide, 3-(N-ethyl-N-isoamylamino)-7-phenoxyfluoran, and the like. Examples of dye precursors developing yellow that can be used as the first dye precursor include 4-[2-[2-(butoxy)phenyl]-6-phenyl-4-pyridinyl]-N,N-dimethylbenzeneamine, 4-[2-[2-(octyloxy)phenyl]-6-phenyl-4-pyridinyl]-N,N-dimethylbenzeneamine, 4-[2-[2-(ethoxy)phenyl]-6-phenyl-4-pyridinyl]-N,N-dimethylbenzeneamine, 4-[2,6-bis(2-ethoxyphenyl)-4-pyridinyl]-N,N-dimethylbenzeneamine, 4-(2,6-diphenyl-4-pyridinyl)-N,N-dimethylbenzeneamine, 4-[2,6-bis(2-butoxyphenyl)-4-pyridinyl]-N,N-dimethylbenzeneamine, 4-[2,6-bis(2-octyloxyphenyl)-4-pyridinyl]-N,N-dimethylbenzeneamine, 4-[2-[2-(hexyloxy)phenyl]-6-phenyl-4-pyridinyl]-N,N-dimethylbenzeneamine, 4-[2,6-bis(2-hexyloxyphenyl)-4-pyridinyl]-N,N-dimethylbenzeneamine, 3,6-dimethoxyfluorane, 1-(4-n-dodecyloxy-3-methoxyphenyl)-2-(2-quinolyl)ethylene, and the like.

Among these yellow-developing dye precursors, 4-[2-[2-(butoxy)phenyl]-6-phenyl-4-pyridinyl]-N,N-dimethylbenzeneamine, 4-[2-[2-(hexyloxy)phenyl]-6-phenyl-4-pyridinyl]-N,N-dimethylbenzeneamine, and 4-[2-[2-(octyloxy)phenyl]-6-phenyl-4-pyridinyl]-N,N-dimethylbenzeneamine, all of which have a pyridine skeleton in their molecular structure, develop vivid yellow; thus, they are more preferred as the dye precursor contained in the thermal color-developing layer capable of developing yellow in the present invention.

In the present invention, the dye precursor contained in the first thermal color-developing layer can be used in the form of dispersed solid fine particles, or composite fine particles obtained by emulsifying and dispersing a liquid composition containing a polyvalent isocyanate compound and the first dye precursor in water, followed by polymerization of the polyvalent isocyanate compound. When the form of composite fine particles is used, the static color-development starting temperature of the first thermal color-developing layer can be adjusted to be lower than the static color-development starting temperatures of the second and third thermal color-developing layers. In the present invention, it is preferable to use the dye precursor contained in the first thermal color-developing layer in the form of dispersed solid fine particles, in terms of immediately developing the single color 1.

In the multicolor thermal recording material of the present invention, the color-developing compound that can be used in the first thermal color-developing layer is selected from those that are liquefied or dissolved due to the temperature increase, and that develop the color of the first dye precursor upon contact with the first dye precursor. Typical examples thereof include phenolic compounds, aromatic carboxylic acids, polyvalent metal salts of these compounds, and like organic acid substances.

The color-developing compound can generally be used in a form in which it is contained in composite fine particles or microcapsules, or in the form of dispersed solid fine particles. The amount of the color-developing compound used is not particularly limited, but is preferably about 30 to 2,000 parts by mass, and more preferably about 50 to 250 parts by mass, based on 100 parts by mass of the dye precursor.

Typical examples of color-developing compounds include 4-tert-butylphenol, 4-acetylphenol, 4-tert-octylphenol, 4,4'-sec-butylidenediphenol, 4-phenylphenol, 4,4'-dihydroxydiphenylmethane, 4,4'-isopropylidenediphenol, 4,4'-dihydroxydiphenylether, 4,4'-cyclohexylidenediphenol, 1,1-bis(4-hydroxyphenyl)ethane, 1,1-bis(4-hydroxyphenyl)-1-phenylethane, 4,4'-dihydroxydiphenylsulfide, 4,4'-thiobis(3-methyl-6-tert-butylphenol), 4,4'-dihydroxydiphenylsulfone, 2,4'-dihydroxydiphenylsulfone, 4-hydroxy-4'-isopropoxydiphenylsulfone, 4-hydroxy-4'-n-propoxydiphenylsulfone, 4-hydroxy-4'-allyloxydiphenylsulfone, bis(3-allyl-4-hydroxyphenyl)sulfone, 4,4'-bis[(4-methyl-3-phenoxycarbonylaminophenyl)ureido]diphenylsulfone, 4-[4'-(1'-methylethyloxyl)phenyl]sulfonyl phenol, N-(p-toluenesulfonyl)-N'-(3-p-toluenesulfonyloxyphenyl)urea, 4,4'-bis(3-tosylureido)diphenylmethane, and like compounds.

Further, examples of compounds that can be used as the color-developing compound include phenolic compounds, such as 4-hydroxybenzophenone, dimethyl 4-hydroxyphthalate, methyl 4-hydroxybenzoate, propyl 4-hydroxybenzoate, sec-butyl 4-hydroxybenzoate, phenyl 4-hydroxybenzoate, benzyl 4-hydroxybenzoate, tolyl 4-hydroxybenzoate, chlorophenyl 4-hydroxybenzoate, and 4,4'-dihydroxydiphenyl ether; aromatic carboxylic acids, such as benzoic acid, p-tert-butylbenzoic acid, trichlorobenzoic acid, terephthalic acid, salicylic acid, 3-tert-butylsalicylate, 3-isopropylsalicylate, 3-benzylsalicylate, 3-(α-methylbenzyl)salicylate, and 3,5-di-tert-butylsalicylate; organic acid substances, such as salts of such phenolic compounds or aromatic carboxylic acids and polyvalent metals, such as zinc, magnesium, aluminum, or calcium; and the like. Of the combinations of a first dye precursor and a color-developing compound, when the first dye precursor is a yellow-developing dye precursor, the specific combination of the first dye precursor and a color-developing compound is preferably, for example, a combination of 4-[2-[2-(butoxy)phenyl]-6-phenyl-4-pyridinyl]-N,N-dimethylbenzeneamine or 4-[2-[2-(octyloxy)phenyl]-6-phenyl-4-pyridinyl]-N,N-dimethylbenzeneamine as the first dye precursor, and 4-hydroxy-4'-isopropoxydiphenylsulfone as the color-developing compound.

When the first dye precursor contained in the first thermal color-developing layer is used in the form of dispersed solid fine particles, the first dye precursor is pulverized with a wet grinding mill, such as a sand grinder, attritor, ball mill, or Cobot mill, using water as a dispersion medium. The pulverized product is dispersed in a dispersion medium, together with a water-soluble polymeric material, such as polyacrylamide, polyvinylpyrrolidone, polyvinyl alcohol, modified polyvinyl alcohol (e.g., sulfone-modified polyvinyl alcohol), methylcellulose, carboxymethylcellulose, styrene-maleic anhydride copolymer salt, or a derivative thereof, and optionally a surfactant, an antifoaming agent, etc., thereby forming a dispersion. The resulting dispersion can be used for the preparation of a first thermal color-developing layer-coating liquid. Alternatively, after the first dye precursor is dissolved in an organic solvent, the resulting solution is emulsified and dispersed in water using a water-soluble polymeric material mentioned above as a stabilizing agent. Then, the organic solvent is evaporated from the emulsion, and the dye precursor can be used in the form of dispersed solid fine particles. In either case, the average particle diameter of the dispersed solid fine particles of the dye precursor used in the form of dispersed solid fine particles is preferably about 0.2 to 3.0 μm, and more preferably about 0.3 to 1.0 μm, so as to obtain suitable color-developing sensitivity. Of course, a dye precursor having the same color can be used in the form of dispersed solid fine particles, together with the composite fine particles.

The first thermal color-developing layer may further contain an image stabilizer mainly for improving the storage properties of colored recording images. The image stabilizer is at least one member selected from, for example, phenolic compounds, such as 1,1,3-tris(2-methyl-4-hydroxy-5-cyclohexylphenyl)butane, 1,1,3-tris(2-methyl-4-hydroxy-5-tert-butylphenyl)butane, 1,1-bis(2-methyl-4-hydroxy-5-tert-butylphenyl)butane, 4,4'-[1,4-phenylenebis(1-methylethylidene)]bisphenol, and 4,4'-[1,3-phenylenebis(1-methylethylidene)]bisphenol; epoxy compounds, such as 4-benzyloxyphenyl-4'-(2-methyl-2,3-epoxypropyloxy)phenylsulfone, 4-(2-methyl-1,2-epoxyethyl)diphenylsulfone, and 4-(2-ethyl-1,2-epoxyethyl)diphenylsulfone; and isocyanuric acid compounds, such as 1,3,5-tris(2,6-dimethylbenzyl-3-hydroxy-4-tert-butyl)isocyanuric acid. Of course, the image stabilizer is not limited to these examples, and two or more compounds can be used in combination, if necessary.

Further, a sensitizer can be used in the first thermal color-developing layer so as to improve thermal recording color-developing sensitivity. The sensitizer may be a compound that is conventionally known as a sensitizer for thermal recording materials. Examples thereof include parabenzylbiphenyl, dibenzyl terephthalate, phenyl 1-hydroxy-2-naphthoate, dibenzyl oxalate, di-o-chlorobenzyl adipate, 1,2-diphenoxyethane, 1,2-di(3-methylphenoxy)ethane, di-p-methylbenzyl oxalate, di-p-chlorobenzyl oxalate, 1,2-bis(3,4-dimethylphenyl)ethane, 1,3-bis(2-naphthoxy)propane, meta-terphenyl, diphenyl, benzophenone, and the like.

The color-developing compound, image stabilizer, sensitizer, and other components contained in the first thermal color-developing layer can be dispersed in water in the same manner as in the case where the dye precursor is used in the form of dispersed solid fine particles, and can be used as a dispersion in the preparation of the thermal color-developing layer-coating liquid. Further, these components can be dissolved in a solvent, and emulsified in water using a water-soluble polymeric material as an emulsifier. Moreover, the image stabilizer and sensitizer may be contained in composite fine particles containing a dye precursor.

Other component materials that constitute the first thermal color-developing layer include an adhesive. Further, a pigment, crosslinking agent, wax, metal soap, oil-repellent agent, colored dye, colored pigment, ultraviolet absorber, fluorescent brightener, etc., can be used as auxiliaries, if necessary.

Examples of adhesives include polyvinyl alcohol and derivatives thereof, starch and derivatives thereof; cellulose derivatives, such as hydroxymethylcellulose, hydroxyethylcellulose, hydroxypropylcellulose, methylcellulose, and ethylcellulose; water-soluble polymeric materials, such as sodium polyacrylate, polyvinylpyrrolidone, acrylamide-acrylic acid ester copolymer, acrylamide-acrylic acid ester-methacrylic acid ester copolymer, styrene-maleic anhydride copolymer, isobutylene-maleic anhydride copolymer, casein, gelatin, and derivatives thereof; emulsions, such as polyvinyl acetate, polyurethane, polyacrylic acid, polyacrylic acid ester, vinyl chloride-vinyl acetate copolymer, polybutyl methacrylate, and ethylene-vinyl acetate copolymer; water-insoluble polymers, such as styrene-butadiene copolymer and styrene-butadiene-acrylic copolymer; and the like. When a water-insoluble polymer is used as an adhesive, it may be used in the form of a latex.

Specific examples of pigments include inorganic pigments, such as calcium carbonate, magnesium carbonate, kaolin, clay, talc, calcined clay, silica, diatomaceous earth, synthetic aluminum silicate, zinc oxide, titanium oxide, aluminum hydroxide, barium sulfate, surface-treated calcium carbonate, and surface-treated silica; and organic pigments, such as urea-formalin resin, styrene-methacrylic acid copolymer resin, and polystyrene resin. In terms of increasing the degree of whiteness and improving the uniformity of images, a particle pigment having a high degree of whiteness and an average particle diameter of 10 μm or less is preferred.

Specific examples of crosslinking agents include aldehyde compounds such as glyoxal, polyamine compounds such as polyethyleneimine, epoxy compounds, polyamide resins, melamine resins, glyoxylic acid salts, dimethylolurea compounds, hydrazine compounds, aziridine compounds, and blocked isocyanate compounds; inorganic compounds, such as ammonium persulfate, ferric chloride, magnesium chloride, sodium tetraborate, and potassium tetraborate; or boric acid, boric acid triester, boron-based polymer; and the like. These may be used singly or in combination of two or more. The crosslinking agent content is not particularly limited, but is preferably within the range of about 1 to 10 mass % based on the total solids content of the first thermal color-developing layer, in terms of improving the water resistance of the thermal color-developing layer.

Specific examples of waxes include paraffin wax, carnauba wax, microcrystalline wax, polyolefin wax, polyethylene wax, and like waxes; higher fatty acid amides, such as stearamide and ethylene bis-stearamide; and higher fatty acid esters, derivatives thereof, and the like. In particular, methylolated fatty acid amide can be preferably used because the sensitization effect can be obtained without deteriorating background fogging.

Specific examples of metal soaps include higher fatty acid polyvalent metal salts, such as zinc stearate, aluminum stearate, calcium stearate, and zinc oleate. In the present invention, it is preferable to incorporate, into the thermal color-developing layer, a colored dye and/or colored pigment that have a color complementary to low-temperature developed color, in terms of controlling the color of the multicolor thermal recording material before printing.

In the present invention, light resistance can also be significantly improved by incorporating, into the first thermal color-developing layer, microcapsules encapsulating an ultraviolet absorber or dispersed solid fine particles of an ultraviolet absorber as an auxiliary.

Specific examples of ultraviolet absorbers include salicylic acid-based ultraviolet absorbers, such as phenyl salicylate, p-tert-butylphenyl salicylate, and p-octylphenyl salicylate; and benzophenone-based ultraviolet absorbers, such as 2,4-dihydroxybenzophenone, 2-hydroxy-4-octyloxybenzophenone, 2-hydroxy-4-methoxybenzophenone, 2-hydroxy-4-dodecyloxybenzophenone, 2,2'-dihydroxy-4-methoxybenzophenone, 2,2'-dihydroxy-4,4'-dimethoxybenzophenone, and 2-hydroxy-4-methoxy-5-sulfobenzophenone.

Other examples include benzotriazole-based ultraviolet absorbers, such as 2-(2'-hydroxy-5'-methylphenyl)benzotriazole, 2-(2'-hydroxy-5'-tert-butylphenyl)benzotriazole, 2-(2'-hydroxy-3',5'-di-tert-butylphenyl)benzotriazole, 2-(2'-hydroxy-3'-tert-butyl-5'-methylphenyl)-5-chlorobenzotriazole, 2-(2'-hydroxy-3',5'-di-tert-butylphenyl)-5-chlorobenzotriazole, 2-(2'-hydroxy-3',5'-di-tert-amylphenyl)benzotriazole, 2-[2'-hydroxy-3'-(3",4",5",6"-tetrahydrophtalimide-methyl)-5'-methylphenyl]benzotriazole, 2-(2'-hydroxy-5'-tert-octylphenyl)benzotriazole, 2-[2'-hydroxy-3',5'-bis(α,α-dimethylbenzyl)phenyl]-2H-benzotriazole, 2-(2'-hydroxy-3'-dodecyl-5'-methylphenyl)benzotriazole, 2-[2'-hydroxy-4'-(2"-ethylhexyl)oxyphenyl]benzotriazole, and condensate of polyethylene glycol (molecular weight: about 300) and methyl-3-[3-tert-butyl-5-(2H-benzotriazol-2-yl)-4-hydroxyphenyl]propionate; cyanoacrylate-based ultraviolet absorbers, such as 2'-ethylhexyl-2-cyano-3,3-diphenylacrylate and ethyl-2-cyano-3,3-diphenylacrylate; and the like. Of course, the ultraviolet absorber is not limited to these examples, and two or more of them can be used in combination, if necessary.

Preferred among these ultraviolet absorbers are benzotriazole ultraviolet absorbers. In particular, more preferred are 2-(2'-hydroxy-5'-methylphenyl)benzotriazole, 2-(2'-hydroxy-3'-tert-butyl-5-methylphenyl)-5-chlorobenzotriazole, 2-(2'-hydroxy-3'-dodecyl-5'-methylphenyl)benzotriazole, 2-[2'-hydroxy-4'-(2"-ethylhexyl)oxyphenyl]benzotriazole, or condensates of methyl-3-[3-tert-butyl-5-(2H-benzotriazol-2-yl)-4-hydroxyphenyl]propionate and polyethylene glycol (molecular weight: about 300), because they can significantly improve light resistance.

The ultraviolet absorber content is not particularly limited, but is preferably about 5 to 70 mass % based on the total solids content of the first thermal color-developing layer. In particular, the ultraviolet absorber content is preferably adjusted to be within the range of about 15 to 50 mass %. When the ultraviolet absorber content is 5 mass % or more, light resistance can be further increased. When the ultraviolet absorber content is 70 mass % or less, the recording sensitivity of the thermal color-developing layer can be improved. Light resistance can be more efficiently improved by incorporating microcapsules encapsulating an ultraviolet absorber or dispersed solid fine particles of an ultraviolet absorber into a protective layer, described later, rather than into the first thermal color-developing layer.

Microcapsules encapsulating an ultraviolet absorber can be prepared by various known methods. In general, such microcapsules are prepared by a method comprising dissolving, if necessary, an ultraviolet absorber mentioned above that is solid or liquid at ordinary temperature in an organic solvent to obtain a core substance (oily liquid), emulsifying and dispersing the core substance in an aqueous medium, and forming a membrane wall composed of a polymeric material around the individual oily liquid drops. Specific examples of the polymeric material that becomes the membrane wall of microcapsules include polyurethane resin, polyurea resin, polyamide resin, polyester resin, polycarbonate resin, amino aldehyde resin, melamine resin, polystyrene resin, styrene-methacrylate copolymer resin, styrene-acrylate resin, gelatin, polyvinyl alcohol, and the like.

In the present invention, the use of a fluorescent brightener in the first thermal color-developing layer is also preferable because it is effective to improve light resistance. Fluorescent brighteners, which absorb light in the ultraviolet region and emit light in the visible light range with a longer wavelength, are widely used as brighteners. The dye precursor contained in the composite fine particles used in the present invention is likely to be degraded by high-energy light in the ultraviolet region to turn yellow; however, when ultraviolet rays are converted to more harmless light in the long wavelength region using a fluorescent brightener, not only can yellowing be prevented, but also the effect on whiteness can be obtained. Moreover, decoloring of printed parts can also be improved by incorporating a fluorescent brightener.

Specific examples of fluorescent brighteners include derivatives of pyrene, coumarin, oxazole, imidazole, imidazolone, pyrazole, benzidine, diaminocarbazole, naphthalic acid, and diaminostilbenedisulfonic acid, and the like. More specific examples thereof include 1,2-bis(5-methyloxazol-2-yl)ethylene, β,4-bis(5-methyloxazol-2-yl)-styrene, 3-ethyloxycarbonyl-7,8-benzocoumarin, N-methyl-4-methoxynaphthalene-1,8-dicarboximide, sodium 4-[3-(4-chlorophenyl)-5-phenyl-1-pyrazolin-1-yl]-benzenesulfonate, 1,2-bis[4-(phenylamino carbonylamino)-2-sodiumoxysulfonylphenyl]ethylene, 1,2-bis{(4-[2-(p-sodiumoxysulfonylanilino)-4-bis(2-hydroxyethyl)amino-1,3,5-triazin-6-yl]amino-2-sodiumoxysulfonylphenyl}ethylene, and the like. Among these compounds, 1,2-bis{4-[2-(p-sodiumoxysulfonylanilino)-4-bis(2-hydroxyethyl)amino-1,3,5-triazin-6-yl]amino-2-sodiumoxysulfonylphenyl}ethylene, which is a diaminostilbenedisulfonic acid derivative, is preferred in terms of the ease of handling during the preparation of the coating liquid.

The fluorescent brightener content is not particularly limited, but is preferably about 0.5 to 15 mass % based on the total solids content of the first thermal color-developing layer. In particular, the fluorescent brightener content is preferably adjusted to be within the range of about 1 to 10 mass %. When the fluorescent brightener content is 0.5 mass % or more, light resistance can be further increased. When the fluorescent brightener content is 10 mass % or less, coloring of the background due to the color of the fluorescent brightener itself can be prevented, and a thermal recording material having an excellent natural paper texture can be obtained.

The first thermal color-developing layer is generally formed by, for example, mixing the first dye precursor and a color-developing compound, and optionally dispersions of an image stabilizer, a sensitizer, and the like, an adhesive, auxiliaries, and additives, using water as a dispersion medium to thereby prepare a first thermal color-developing layer-coating liquid, and applying the coating liquid to the support, followed by drying. Examples of additives include antifoaming agents, viscosity modifiers; fatty acid alkali metal salts, such as sodium dioctylsulfosuccinate, sodium dodecylbenzenesulfonate, sodium lauryl alcohol sulfonate, and sodium stearate; surfactants, such as fluorochemical surfactants; and the like.

Although the coating amount of the first thermal color-developing layer-coating liquid is not particularly limited, the amount by dry weight is preferably about 2.0 to 10.0 g/m$^2$, and more preferably about 3.0 to 7.0 g/m$^2$.

(3) Intermediate Layer

The intermediate layer provided between the first and second thermal color-developing layers may be a water-soluble polymeric material conventionally used for known thermal recording materials. Specific examples thereof include those used as adhesives mentioned in "(2) First thermal color-developing layer" above. Moreover, the intermediate layer may contain, as auxiliaries, a highly-porous pigment, such as silica or calcined kaolin; a plastic pigment, hollow particles, a foamed body, polyethylene wax with a glass transition point or a melting point, and like organic compounds.

The intermediate layer is generally formed by mixing, for example, a water-soluble polymeric material and optionally auxiliaries and various additives, such as surfactants, using water as a dispersion medium to thereby prepare an intermediate layer-coating liquid, and applying the coating liquid to the first thermal color-developing layer, followed by drying.

Although the coating amount of the intermediate layer-coating liquid is not particularly limited, the amount by dry weight is preferably about 3.0 to 40.0 g/m$^2$, and more preferably about 8.0 to 35.0 g/m$^2$.

(4) Second Thermal Color-Developing Layer

In the multicolor thermal recording material of the present invention, the second thermal color-developing layer contains a particle component containing a second dye precursor, and a color-developing compound reactive with the second dye precursor under heating to develop the color of the second dye precursor. The second dye precursor is not limited to a single compound. Two or more dye precursors having different colors can be mixed to achieve a desired color.

The second dye precursor-containing particle component comprises composite fine particles containing the second dye precursor and a polymeric compound. The composite fine particles contained in the second thermal color-developing layer are preferably obtained, for example, by emulsifying and dispersing a liquid composition containing a polyvalent isocyanate compound and the second dye precursor in water, followed by polymerization of the polyvalent isocyanate compound.

A polyvalent isocyanate compound forms polyurea or polyurea-polyurethane by the reaction with water. A single polyvalent isocyanate compound may be used; alternatively usable is a mixture of a polyvalent isocyanate compound and a polyol or polyamine reactive with the polyvalent isocyanate compound, an adduct of a polyvalent isocyanate compound and a polyol, or a multimer of a polyvalent isocyanate compound, such as biuret or isocyanurate body. The second dye precursor is dissolved in such a polyvalent isocyanate compound, and the resulting solution is emulsified and dispersed in an aqueous medium containing a protective colloid substance (e.g., polyvinyl alcohol) in a dissolved state. Further, using, if necessary, a polyamine compound (e.g., polyethyleneimine) as a reaction accelerator, the emulsified dispersion is heated to thereby polymerize the polyvalent isocyanate compound. This converts the polyvalent isocyanate compound into a polymeric compound, and composite fine particles containing the second dye precursor can be formed.

The composite fine particles contained in the second thermal color-developing layer comprise a base material composed of at least one polymeric material (resin) selected from polyurea and polyurethane polyurea, and a second dye precursor contained in the base material. The second dye precursor and the polymeric material are considered to be present in a solid solution state. It is preferable that the composite fine particles do not contain liquid, such as an oily solvent, in terms of preventing pressure fogging.

A coloring body of the second dye precursor contained in the composite fine particles has very superior storage properties, and particularly superior resistance to oil and plasticizers, compared to a coloring body color-developed in the form of dispersed solid fine particles. Although there is not always a clear reason for this, the coloring body and the polymeric material (base material) are considered to have a certain interaction to make them stable.

The appearance of the composite fine particles used in the present invention is almost a spherical shape or a somewhat concave erythrocyte-like shape when observed with an electron microscope. The cross-sectional shape observed with an electron microscope is solid, porous, or hollow. Moreover, the average particle diameter is preferably about 0.2 to 1.5 μm so as to obtain appropriate color-developing sensitivity. An average particle diameter of 0.2 μm or more is preferred because deterioration of the storage properties of colored parts against the oil, plasticizer, etc., can be prevented.

As the method for producing the composite fine particles used in the present invention, for example, the method disclosed in JPH09-295457A can be used.

As the second dye precursor used in the second thermal color-developing layer, specific examples of dye precursors providing black, blue, cyan, green, red, magenta, and yellow, and dye precursors having absorption in the near-infrared region include the same dye precursors used as the first dye precursor, mentioned in "(2) First thermal color-developing layer" above.

Moreover, specific examples of the color-developing compound used in the second thermal color-developing layer include the same color-developing compounds reactive with the first dye precursor under heating to develop the color of the first dye precursor, mentioned in "(2) First thermal color-developing layer" above.

As the combination of the second thermal color-developing layer and the color-developing compound, for example, when the second thermal color-developing layer is capable of developing magenta, a specific example of the combination of the second dye precursor and the color-developing compound is preferably a combination of 3-(N-ethyl-N-isoamylamino)-7,8-benzofluoran as the second dye precursor, and 2,4'-dihydroxydiphenylsulfone or 4-hydroxy-4'-isopropoxydiphenylsulfone as the color-developing compound.

In addition to a dye precursor, the composite fine particles used in the present invention may contain, if necessary, an ultraviolet absorber, an antioxidant, an oil-soluble fluorescent dye, and a mold-releasing agent, as well as a sensitizer, etc., known for thermal recording materials. Specific examples of such substances include those mentioned in "(2) First thermal color-developing layer" above.

The second thermal color-developing layer of the present invention may contain an image stabilizer mainly for improving the storage properties of colored recording images, and a sensitizer for improving thermal recording color-developing sensitivity. Specific examples of these components and their contents include those mentioned in "(2) First thermal color-developing layer" above.

Further, the second thermal color-developing layer may contain, if necessary, an adhesive, auxiliaries, additives, and the like mentioned in "(2) First thermal color-developing layer" above.

The ultraviolet absorber used as an auxiliary is preferably encapsulated in microcapsules. In microcapsules encapsulating an ultraviolet absorber, the ultraviolet absorber serves as a core substance in a liquid form, and is protected by a capsule wall material. Such microcapsules are completely different from composite fine particles containing a dye precursor in which the dye precursor and a polymeric material are presumably present in a solid solution state, in terms of the presence state, shape, and desired function.

The second thermal color-developing layer is generally formed by, for example, mixing second dye precursor-containing composite fine particles and a color-developing compound, and optionally dispersions of an image stabilizer, a sensitizer, and the like, an adhesive, auxiliaries, and additives, using water as a dispersion medium to thereby prepare a second thermal color-developing layer-coating liquid, and applying the coating liquid to the intermediate layer, followed by drying.

Although the coating amount of the second thermal color-developing layer is not particularly limited, the amount by dry weight is preferably about 2.0 to 10.0 g/m$^2$, and more preferably about 3.0 to 7.0 g/m$^2$.

(5) Third Thermal Color-Developing Layer

In the multicolor thermal recording material of the present invention, the third thermal color-developing layer contains a particle component containing a third dye precursor, and a color-developing compound reactive with the third dye precursor under heating to develop the color of the third dye precursor. The third dye precursor is not limited to a single compound. Two or more dye precursors having different colors can be mixed to achieve a desired color.

The third dye precursor-containing particle component comprises composite fine particles containing the third dye precursor and a polymeric compound. The composite fine particles contained in the third thermal color-developing layer are obtained by emulsifying and dispersing a liquid composition containing a polyvalent isocyanate compound and the third dye precursor in water, followed by polymerization of the polyvalent isocyanate compound.

Specific examples of the third dye precursor-containing composite fine particles obtained by the polymerization of a polyvalent isocyanate compound, and the production method thereof include those mentioned in "(4) Second thermal color-developing layer" above.

As the third dye precursor used in the third thermal color-developing layer, specific examples of dye precursors developing black, blue, cyan, green, red, magenta, and yellow, and dye precursors having absorption in the near-infrared region include the same dye precursors used as the first dye precursor, mentioned in "(2) First thermal color-developing layer" above.

Moreover, specific examples of the color-developing compound used in the third thermal color-developing layer include the same color-developing compounds reactive with the first dye precursor under heating to develop the color of the first dye precursor, mentioned in "(2) First thermal color-developing layer" above.

As the combination of the third thermal color-developing layer and the color-developing compound, for example, when the third thermal color-developing layer is capable of developing cyan, a specific example of the combination of the third dye precursor and the color-developing compound is preferably a combination of 3-(1-ethyl-2-methylindol-3-yl)-3-(4-diethylamino-2-methylphenyl)-4-azaphthalide as the third dye precursor, and 4,4'-bis(3-tosylureido)diphenylmethane or a zinc salt of 3,5-di-α-methylbenzyl salicylic acid as the color-developing compound.

In addition to a dye precursor, the composite fine particles used in the present invention may contain, if necessary, an ultraviolet absorber, an antioxidant, an oil-soluble fluorescent dye, and a mold-releasing agent, as well as a sensitizer, etc., known for thermal recording materials. Specific examples of such substances include those mentioned in "(2) First Thermal Color-developing Layer" above.

The second thermal color-developing layer of the present invention may contain an image stabilizer mainly for improving the storage properties of colored recording images, and a sensitizer for improving thermal recording color-developing sensitivity. Specific examples of these components and their contents include those mentioned in "(2) First thermal color-developing layer" above.

Further, the third thermal color-developing layer may contain, if necessary, an adhesive, auxiliaries, additives, and the like mentioned in "(2) First thermal color-developing layer" above.

In particular, when a pigment is used as an auxiliary, it is preferable to use a pigment having oil absorption of 50 ml/100 g or more so as to prevent adhesion of scum to the thermal head and sticking. The pigment content is not particularly limited, but is preferably an amount that does not reduce the coloring density, that it, 50 mass % or less based on the total solids content of the thermal color-developing layer.

Moreover, the ultraviolet absorber used as an auxiliary is preferably encapsulated in microcapsules. In particular, microcapsules having a membrane wall composed of a polyurethane-polyurea resin or amino aldehyde resin have excellent heat resistance, and thus exhibit an excellent accompanying effect of serving as an inorganic pigment added to the thermal color-developing layer or protective layer for the purpose of preventing sticking to the thermal head. Moreover, they have a lower refractive index than general pigments and microcapsules with other membrane walls, and have a spherical shape; therefore, when the third thermal color-developing layer contains a large mount of the microcapsules, there is no possibility of causing density reduction due to scattered reflection of light. Thus, such microcapsules are preferably used.

The third thermal color-developing layer is generally formed by, for example, mixing third dye precursor-containing composite fine particles and a color-developing compound, and optionally dispersions of an image stabilizer and a sensitizer, an adhesive, auxiliaries, and other additives, using water as a dispersion medium to thereby prepare a third thermal color-developing layer-coating liquid, and applying the coating liquid to the second thermal color-developing layer, followed by drying.

Although the coating amount of the third thermal color-developing layer-coating liquid is not particularly limited, the amount by dry weight is preferably about 2.0 to 10.0 g/m$^2$, more preferably about 3.0 to 7.0 g/m$^2$, and even more preferably about 3.5 to 7.0 g/m$^2$.

(6) Protective Layer

In the present invention, on the thermal color-developing layer, it is preferable to provide a protective layer containing a water-soluble polymeric material and a pigment conventionally used for known thermal recording materials. Examples of the water-soluble polymeric material and pigment include the materials mentioned in "(2) First thermal color-developing layer" above. In this case, it is more preferable to use a crosslinking agent as an auxiliary to impart water resistance to the protective layer.

In the present invention, light resistance can also be significantly improved by incorporating, into the protective layer, microcapsules encapsulating an ultraviolet absorber or dispersed solid fine particles of an ultraviolet absorber as an auxiliary. In particular, microcapsules having a membrane wall composed of a polyurethane-polyurea resin or amino aldehyde resin have excellent heat resistance, and thus exhibit an excellent accompanying effect of serving as an inorganic pigment added to the thermal color-developing layer or protective layer for the purpose of preventing sticking to the thermal head. Moreover, they have a lower refractive index than general pigments and microcapsules with other membrane walls, and have a spherical shape; therefore, when the protective layer contains a large mount of the microcapsules, there is no possibility of causing density reduction due to scattered reflection of light. Thus, such microcapsules are preferably used.

Moreover, a fluorescent brightener is preferably used because the effect of improving light resistance can be obtained by adding it to the protective layer.

Furthermore, when a pigment is added, adhesion of scum to the thermal head and sticking can be prevented. It is preferable to use a pigment having oil absorption of 50 ml/100 g or more. The pigment content is preferably an amount that does not reduce the coloring density, that it, 50 mass % or less based on the total solids content of the protective layer.

The protective layer is generally formed by, for example, mixing a water-soluble polymeric material, a pigment, a crosslinking agent, and auxiliaries (e.g., wax), and optionally various additives (e.g., surfactant), using water as a dispersion medium to thereby prepare a protective layer-coating liquid, and applying the coating liquid to the third thermal color-developing layer, followed by drying.

Although the coating amount of the protective layer-coating liquid is not particularly limited, the amount by dry weight is preferably about 0.5 to 10 g/m$^2$, and more preferably about 1 to 5 g/m$^2$.

(7) Resin Layer

In the present invention, a resin layer can also be formed on the thermal color-developing layer or protective layer by curing an electron-beam-curable resin or an ultraviolet-curable resin containing a photopolymerization initiator by irradiation with electron rays or ultraviolet rays. Examples of resins cured by electron rays are described in JPS58-177392A, JPS58-177392A, etc. Such a resin may suitably contain a non-electron-beam-curable resin, a pigment, an antifoaming agent, a leveling agent, a lubricant, a surfactant, a plasticizer, and other additives. In particular, addition of pigments, such as calcium carbonate and aluminum hydroxide, and lubricants, such as waxes and silicon, is preferable because it is useful to prevent sticking to the thermal head.

The resin layer cured by electron rays or ultraviolet rays is preferably applied so that the coating amount after drying is about 0.5 to 10 g/m$^2$, and more preferably about 1 to 5 g/m$^2$.

In the present invention, the multicolor thermal recording material can also be printed with UV ink, flexo ink, or the like. In this case, printing may be performed on the front and rear sides of the support, or the surface of the thermal color-developing layer, intermediate layer, protective layer, electron-beam-curable-resin layer, or ultraviolet-curable-resin layer. Printing may be performed on all or part of the surface.

(8) Other Layers

In the present invention, in order to increase the added value of the multicolor thermal recording material, the multicolor thermal recording material can be further processed to have higher functionality. For example, the rear side can be coated with an adhesive, remoistening adhesive, or delayed-tack adhesive to thereby form adhesive paper, remoistening adhesive paper, or delayed-tack paper, respectively. In particular, a product obtained by subjecting the multicolor thermal recording material of the present invention to adhesion treatment is useful as a thermal label because of its excellent visibility. Moreover, the rear side can be processed to have the function of thermal transfer paper, inkjet printing paper, no-carbon paper, dielectric-coated paper, and xerographic paper to thereby form recording paper that allows two-sided recording. A double-sided thermal recording material can also be formed. Furthermore, a back layer can also be provided so as to prevent infiltration of the oil or plasticizer from the rear side of the recording material, or for curling control or charge prevention.

In the present invention, a magnetic recording layer can also be provided on the surface of the support on which no thermal color-developing layer is provided, or between the support and the thermal color-developing layer. The magnetic recording layer may be one that is conventionally used for magnetic tickets, prepaid cards, magnetic season tickets, etc. It is preferable to form a magnetic recording layer before the step of applying a thermal color-developing layer, in terms of maintaining a high degree of whiteness of the thermal color-developing layer, not only when the magnetic recording layer is provided between the support and the thermal color-developing layer, but also when the magnetic recording layer is provided on the surface of the support on which no thermal color-developing layer is provided.

In the present invention, an undercoat layer conventionally used for known thermal recording materials can also be used. In particular, when the support is paper, it is preferable to provide an undercoat layer. When a highly porous pigment, such as silica or calcined kaolin, is used in the undercoat layer, the color-developing sensitivity of the thermal color-developing layer can be increased. Moreover, the incorporation of a plastic pigment, hollow particles, a foamed body, etc., to the undercoat layer is also effective to improve the color-developing sensitivity of the thermal color-developing layer formed on the undercoat layer.

Method for Producing Multicolor Thermal Recording Material

The thermal color-developing layers and the intermediate layer may be individually applied and dried using, for the thermal color-developing layers, thermal color-developing layer-coating liquids each containing a dye precursor and a color-developing compound, and using, for the intermediate layer, an intermediate layer-coating liquid containing a water-soluble polymeric material. Alternatively, simultaneous multilayer coating may be performed to apply two or more layers simultaneously. The simultaneous multilayer coating is a method for applying two or more layers, wherein upper and lower layers are simultaneously applied. This method includes a method for applying a lower layer, and then applying an upper layer without drying the lower layer.

Examples of the method for forming each of the above layers on the support include air-knife coating, blade coating, gravure coating, roll coating, spray coating, dip coating, bar coating, curtain coating, slot-die coating, slide-die coating, extrusion coating, and other known coating methods.

In the present invention, it is preferable to perform smoothing treatment by using a known smoothing method, such as super calender or soft calender, after each layer is formed, or in any stage after all layers are formed. This treatment can increase the color-developing sensitivity and improve the image quality and color separation properties. The surface on the thermal color-developing layer side may be treated by bringing it into contact with either of the metal roll and elastic roll of the calender.

The coating amount of each layer after drying in the production of the multicolor thermal recording material may be the amount mentioned above. Moreover, the total coating amount of the first, second, and third thermal color-developing layers is preferably about 6.0 to 30.0 g/m$^2$, and more preferably about 9.0 to 21.0 g/m$^2$.

EXAMPLES

The present invention is described in more detail below with reference to Examples. The present invention, however, is not limited to those Examples. In the Examples, "parts" and "%" represent "parts by mass" and "percent by mass", respectively, unless otherwise specified. Moreover, the volume average particle diameters of the color-developing compound, dye precursor, composite particles, and the pigment mixed in the protective layer were measured using a laser diffraction particle size analyzer SALD-2200 (produced by Shimadzu Corp.).

Example 1

Preparation of A Liquid (Solid Fine Particle Dispersion of Yellow-Developing Dye Precursor)

4-[2-[2-(butoxy)phenyl]-6-phenyl-4-pyridinyl]-N,N-dimethylbenzeneamine (40 parts), 40 parts of 10% aqueous solution of polyvinyl alcohol (polymerization degree: 500, saponification degree: 88%), and 20 parts of water were mixed, and the mixture was pulverized and dispersed by using a vertical sand mill (Sand Grinder, produced by IMEX Co., Ltd.) so that the volume average particle diameter was 0.7 μm, thereby obtaining a solid fine particle dispersion of a yellow-developing dye precursor (A liquid).

Preparation of B Liquid (Composite Fine Particle Dispersion Containing Magenta-Developing Dye Precursor)

3-(N-ethyl-N-isoamylamino)-7,8-benzofluoran (20 parts) was dissolved by heating (150° C.) in a mixed solvent comprising 9.5 parts of dicyclohexylmethane-4,4'-diisocyanate (trade name: Desmodur (registered trademark) W, produced by Sumika Bayer Urethane Co., Ltd.) and 9.5 parts of m-tetramethylxylylene diisocyanate (trade name: TMXDI (registered trademark), produced by Nihon Cytec Industries). The resulting solution was gradually added to 90 parts of aqueous solution containing 8.8 parts of polyvinyl alcohol (trade name: Poval (registered trademark) PVA-217EE, produced by Kuraray) and 2 parts of an ethylene oxide adduct of acetylene glycol (trade name: Olfine (registered trademark) E1010, produced by Nissin Chemical Industry Co., Ltd.) as a surfactant. The mixture was emulsified and dispersed by stirring using a homogenizer at a rotational frequency of 10,000 rpm. Water (50 parts) and an aqueous solution prepared by dissolving 1.5 parts of polyvalent amine compound (trade name: EPOMIN SP-006, produced by Nippon Shokubai Co., Ltd.) in 13.5 parts of water were added to the emulsified dispersion, and the mixture was homogenized. The emulsified dispersion was heated to 80° C., and polymerization was performed for 6 hours, thereby preparing a composite fine particle dispersion (B liquid) containing a magenta-developing dye precursor having a volume average particle diameter of 0.8 μm. The dispersion was diluted with water to a solids content of 25%.

Preparation of C Liquid (Composite Fine Particle Dispersion Containing Cyan-Developing Dye Precursor)

3-(1-ethyl-2-methylindol-3-yl)-3-(4-diethylamino-2-methylphenyl)-4-azaphthalide (20 parts) was dissolved by heating (150° C.) in a mixed solvent comprising 14 parts of dicyclohexylmethane-4,4'-diisocyanate (trade name: Desmodur (registered trademark) W, produced by Sumika Bayer Urethane Co., Ltd.) and 5 parts of m-tetramethylxylylene diisocyanate (trade name: TMXDI (registered trademark), produced by Nihon Cytec Industries). The resulting solution was gradually added to 90 parts of aqueous solution containing 8.8 parts of polyvinyl alcohol (trade name: Poval (registered trademark) PVA-217EE, produced by Kuraray) and 2 parts of ethylene oxide adduct of acetylene glycol (trade name: Olfine (registered trademark) E1010, produced by Nissin Chemical Industry Co., Ltd.) as a surfactant. The mixture was emulsified and dispersed by stirring using a homogenizer at a rotational frequency of 10,000 rpm. Water (50 parts) and an aqueous solution prepared by dissolving 1.5 parts of polyvalent amine compound (trade name: EPOMIN SP-006, produced by Nippon Shokubai Co., Ltd.) in 13.5 parts of water were added to the emulsified dispersion, and the mixture was homogenized. The emulsified dispersion was heated to 80° C., and polymerization was performed for 6 hours, thereby preparing a composite fine particle dispersion (C liquid) containing a cyan-developing dye precursor having a volume average particle diameter of 0.8 μm. The dispersion was diluted with water to a solids content of 25%.

Preparation of D Liquid (Color-Developing Compound Dispersion)

A composition comprising 40 parts of 4-hydroxy-4'-isopropoxydiphenylsulfone, 40 parts of 10% aqueous solution of polyvinyl alcohol (polymerization degree: 500, saponification degree: 88%), and 20 parts of water was pulverized with an Ultra Visco Mill until the volume average particle diameter reached 1.5 μm. Thus, a color-developing compound dispersion (D liquid) was obtained.

Preparation of E Liquid (Color-Developing Compound Dispersion)

A composition comprising 40 parts of 2,4'-dihydroxydiphenylsulfone, 40 parts of 10% aqueous solution of polyvinyl alcohol (polymerization degree: 500, saponification degree: 88%), and 20 parts of water was pulverized with an Ultra Visco Mill until the volume average particle diameter reached 0.80 μm. Thus, a color-developing compound dispersion (E liquid) was obtained.

Preparation of F Liquid (Color-Developing Compound Dispersion)

A composition comprising 40 parts of 4,4'-bis(3-tosylureido)diphenylmethane, 40 parts of 10% aqueous solution of polyvinyl alcohol (polymerization degree: 500, saponification degree: 88%), and 20 parts of water was pulverized with an Ultra Visco Mill until the volume average particle diameter reached 0.80 μm. Thus, a color-developing compound dispersion (F liquid) was obtained.

Preparation of G Liquid (Sensitizer Dispersion)

1,2-di(3-methylphenoxy)ethane (40 parts), 40 parts of 10% aqueous solution of polyvinyl alcohol (polymerization degree: 500, saponification degree: 88%), 20 parts of water were mixed, and the mixture was pulverized and dispersed by using a vertical sand mill (Sand Grinder, produced by IMEX Co., Ltd.) so that the average particle diameter was 1.0 μm, thereby obtaining a sensitizer dispersion (G liquid).

Preparation of Intermediate Layer-Coating Liquid (1)

A 10% polyvinyl alcohol aqueous solution (trade name: Poval (registered trademark) PVA-110, produced by Kuraray; 100 parts) and 1 part of 5% surfactant aqueous solution (trade name: SN-Wet OT-70, produced by San Nopco Ltd.) were mixed and stirred, thereby obtaining an intermediate layer-coating liquid (1).

Static Color-Development Starting Temperature

The following thermal color-developing layer-coating liquids were each applied to one side of synthetic paper (trade name: FPG-80, produced by Yupo Corporation; thickness: 80 μm) so that the coating amount after drying was 6 g/m$^2$, followed by drying. Thus, single-layer sheets for measuring static color-development starting temperature were prepared. The color of each of the obtained sheets was developed for every 10° C. using a heat seal tester (produced by Toyo Seiki Seisaku-sho, Ltd.) under conditions in which a hot plate was pressed at $9.8\times10^4$ Pa, and the contact time was 5 seconds, at 50 to 220° C. The coloring densities of the yellow, cyan, and magenta components were measured with a densitometer (X-Lite580). A linear interpolation was performed between temperatures at which the coloring densities were right at both sides of 0.2, and the temperature corresponding to a coloring density of 0.2 was determined. The obtained temperature was regarded as the static color-development starting temperature.

Preparation of First Thermal Color-Developing Layer-Coating Liquid (I)

A composition comprising 20 parts of A liquid, 5 parts of styrene-butadiene latex (trade name: L1571, produced by Asahi Kasei Corp.; solids content: 48%), 25 parts of 10% polyvinyl alcohol aqueous solution (trade name: Poval (registered trademark) PVA-110, produced by Kuraray), 23 parts of D liquid, parts of G liquid, 2 parts of 5% surfactant aqueous solution (trade name: SN-Wet OT-70, produced by San Nopco Ltd.), and 17 parts of water were mixed and stirred, thereby obtaining a first thermal color-developing layer-coating liquid (I). The static color-development starting temperature was 73° C.

Preparation of Second Thermal Color-Developing Layer-Coating Liquid (II)

A composition comprising 27 parts of B liquid, 5 parts of styrene-butadiene latex (trade name: L1571, produced by Asahi Kasei Corp.; solids content: 48%), 25 parts of 10% polyvinyl alcohol aqueous solution (trade name: Poval (registered trademark) PVA-110, produced by Kuraray), 30 parts of E liquid, 2 parts of 5% surfactant aqueous solution (trade name: SN-Wet OT-70, produced by San Nopco Ltd.), and 11 parts of water was mixed and stirred, thereby obtaining a second thermal color-developing layer-coating liquid (II). The static color-development starting temperature was 115° C.

Preparation of Third Thermal Color-Developing Layer-Coating Liquid (III)

A composition comprising 27 parts of C liquid, 5 parts of styrene-butadiene latex (trade name: L1571, produced by Asahi Kasei Corp.; solids content: 48%), 25 parts of 10% polyvinyl alcohol aqueous solution (trade name: Poval (registered trademark) PVA-110, produced by Kuraray), 30 parts of F liquid, 2 parts of 5% surfactant aqueous solution (trade name: SN-Wet OT-70, produced by San Nopco Ltd.), and 11 parts of water was mixed and stirred, thereby obtaining a third thermal color-developing layer-coating liquid (III). The static color-development starting temperature was 185° C.

Preparation of H Liquid (Kaolin Dispersion)

Kaolin (trade name: UW-90 (registered trademark), produced by BASF; 80 parts), 1 part of 40% aqueous solution of sodium polyacrylate (trade name: Aron T-50, produced by Toagosei Co., Ltd.), and 53 parts of water were mixed, and the mixture was pulverized by using a sand mill until the volume average particle diameter reached 1.6 μm, thereby obtaining a kaolin dispersion (H liquid).

Preparation of Protective Layer-Coating Liquid

A composition comprising 25 parts of H liquid, 50 parts of 15% aqueous solution of acetoacetyl-modified polyvinyl alcohol (trade name: Gohsefimer (registered trademark) Z-200, produced by Nippon Synthetic Chemical Industry Co., Ltd.; polymerization degree: about 1,000, saponification degree: about 98 mol %), 7.5 parts of paraffin wax (trade name: Hidorin P-7, produced by Chukyo Yushi Co., Ltd.; solids content: 30%), 5 parts of 5% surfactant aqueous solution (trade name: SN-Wet OT-70, produced by San Nopco Ltd.), 0.3 parts of Glyoxal (produced by Nippon Synthetic Chemical Industry Co., Ltd.; solids content: 40%), and 12.5 parts of water was mixed and stirred, thereby obtaining a protective layer-coating liquid.

Production of Thermal Recording Material 1

The first thermal color-developing layer-coating liquid (I) was applied to one side of synthetic paper (trade name: FPG-80, produced by Yupo Corporation; thickness: 80 μm) using a Meyer bar so that the coating amount after drying was 6 g/m$^2$, followed by drying to thereby provide a first thermal color-developing layer. The intermediate layer-coating liquid (1) was applied to the first thermal color-developing layer using a Meyer bar so that the coating amount after drying was 30 g/m$^2$, followed by drying to thereby provide an intermediate layer. The second thermal color-developing layer-coating liquid (II) was applied to the intermediate layer using a Meyer bar so that the coating amount after drying was 5 g/m$^2$, followed by drying to thereby provide a second thermal color-developing layer. The third thermal color-developing layer-coating liquid (III) was applied to the second thermal color-developing layer using a Meyer bar so that the coating amount after drying was 5 g/m$^2$, followed by drying to thereby provide a third thermal color-developing layer. Further, the protective layer-coating liquid was applied to the third thermal color-developing layer using a Meyer bar so that the coating amount after drying was 3 g/m$^2$, followed by drying to thereby provide a protective layer. Thus, a thermal recording material 1 was obtained.

Example 2

Production of Thermal Recording Material 2

A thermal recording material 2 was obtained in the same manner as in Example 1, except that the coating amount of the intermediate layer was changed from 30 g/m$^2$ to 20 g/m$^2$ in the production of the thermal recording material 1 of Example 1.

Example 3

Production of Thermal Recording Material 3

A thermal recording material 3 was obtained in the same manner as in Example 1, except that the coating amount of the third thermal color-developing layer-coating liquid (III) was changed from 5 g/m$^2$ to 3 g/m$^2$ in the production of the thermal recording material 1 of Example 1.

Example 4

Preparation of Second Thermal Color-Developing Layer-Coating Liquid (IV)

A composition comprising 27 parts of B liquid, 5 parts of styrene-butadiene latex (trade name: L1571, produced by Asahi Kasei Corp.; solids content: 48%), 25 parts of 10% polyvinyl alcohol aqueous solution (trade name: Poval (registered trademark) PVA-110, produced by Kuraray), 30 parts of D liquid, 2 parts of 5% surfactant aqueous solution (trade name: SN-Wet OT-70, produced by San Nopco Ltd.), and 11 parts of water was mixed and stirred, thereby obtaining a third thermal color-developing layer-coating liquid (IV). The static color-development starting temperature was 105° C.

Preparation of I liquid (color-developing compound dispersion)

A composition comprising 40 parts of zinc salt of 3,5-di-α-methylbenzyl salicylic acid, 40 parts of 10% aqueous solution of polyvinyl alcohol (polymerization degree: 500, saponification degree: 88%), and 20 parts of water was pulverized by an Ultra Visco Mill until the volume average particle diameter reached 0.80 μm. Thus, a color-developing compound dispersion (I liquid) was obtained.

Preparation of Third Thermal Color-Developing Layer-Coating Liquid (V)

A composition comprising 27 parts of C liquid, 5 parts of styrene-butadiene latex (trade name: L1571, produced by Asahi Kasei Corp.; solids content: 48%), 25 parts of 10% polyvinyl alcohol aqueous solution (trade name: Poval (registered trademark) PVA-110, produced by Kuraray), 30 parts of I liquid, 2 parts of 5% surfactant aqueous solution (trade name: SN-Wet OT-70, produced by San Nopco Ltd.), and 11 parts of water was mixed and stirred, thereby obtaining a third thermal color-developing layer-coating liquid (V). The static color-development starting temperature was 180° C.

Production of Thermal Recording Material 4

A thermal recording material 4 was obtained in the same manner as in Example 1, except that the second thermal color-developing layer-coating liquid (IV) was used in place of the second thermal color-developing layer-coating liquid (II), and the third thermal color-developing layer-coating liquid (V) was used in place of the third thermal color-developing layer-coating liquid (III), in the production of the thermal recording material of Example 1.

Example 5

Preparation of Intermediate Layer-Coating Liquid (2)

A 10% polyvinyl alcohol aqueous solution (trade name: Poval (registered trademark) PVA-110, produced by Kuraray; 60 parts), 10 parts of 40% polyethylene wax (trade name: SN Coat 289), and 1 part of 5% surfactant aqueous solution (trade name: SN-Wet OT-70, produced by San Nopco Ltd.) were mixed and stirred, thereby obtaining an intermediate layer-coating liquid (2).

A thermal recording material 5 was obtained in the same manner as in Example 1, except that the intermediate layer-coating liquid (2) was used in place of the intermediate layer-coating liquid (1), and the coating amount was changed from 30 g/m$^2$ to 10 g/m$^2$, in the production of the thermal recording material 1 of Example 1.

Comparative Example 1

Production of Thermal Recording Material 6

A thermal recording material 6 was obtained in the same manner as in Example 1, except that an intermediate layer was not provided in the production of the thermal recording material 1 of Example 1.

Comparative Example 2

Preparation of J Liquid (Solid Fine Particle Dispersion of Magenta-Developing Dye Precursor)

3-(N-ethyl-N-isoamylamino)-7,8-benzofluoran (40 parts), parts of 10% aqueous solution of polyvinyl alcohol (polymerization degree: 500, saponification degree: 88%), and 20 parts of water were mixed, and the mixture was pulverized and dispersed by using a vertical sand mill (Sand Grinder, produced by IMEX Co., Ltd.) so that the average particle diameter was 0.7 μm, thereby obtaining a solid fine particle dispersion of a magenta-developing dye precursor (J liquid).

Preparation of Second Thermal Color-Developing Layer-Coating Liquid (VI)

A composition comprising 27 parts of J liquid, 5 parts of styrene-butadiene latex (trade name: L1571, produced by Asahi Kasei Corp., solids content: 48%), 25 parts of 10% polyvinyl alcohol aqueous solution (trade name: Poval (registered trademark) PVA-110, produced by Kuraray), 30 parts of E liquid, 2 parts of 5% surfactant aqueous solution (trade name: SN Wet OT-70, produced by San Nopco Ltd.), and 11 parts of water was mixed and stirred, thereby obtaining a second thermal color-developing layer-coating liquid (VI). The static color-development starting temperature was 95° C.

Production of Thermal Recording Material 7

A thermal recording material 7 was obtained in the same manner as in Example 1, except that the second thermal color-developing layer-coating liquid (VI) was used in place of the second thermal color-developing layer-coating liquid (II) in the production of the thermal recording material 1 of Example 1.

Comparative Example 3

Preparation of K Liquid (Solid Fine Particle Dispersion of Cyan-Developing Dye Precursor)

3-(1-ethyl-2-methylindol-3-yl)-3-(4-diethylamino-2-methylphenyl)-4-azaphthalide (40 parts), 40 parts of 10% aqueous solution of polyvinyl alcohol (polymerization degree: 500, saponification degree: 88%), and 20 parts of water were mixed, and the mixture was pulverized and dispersed by using a vertical sand mill (Sand Grinder, produced by IMEX Co., Ltd.) so that the average particle diameter was 0.6 μm, thereby obtaining a solid fine particle dispersion of a cyan-developing dye precursor (K liquid).

Preparation of Third Thermal Color-Developing Layer-Coating Liquid (VII)

A composition comprising 27 parts of K liquid, 5 parts of styrene-butadiene latex (trade name: L1571, produced by Asahi Kasei Corp., solids content: 48%), 25 parts of 10% aqueous solution of polyvinyl (trade name: Poval (registered trademark) PVA-110, produced by Kuraray), 30 parts of F liquid, 2 parts of 5% surfactant aqueous solution (trade name: SN Wet OT-70, produced by San Nopco Ltd.), and 11 parts of water was mixed and stirred, thereby obtaining a third thermal color-developing layer-coating liquid (VII). The static color-development starting temperature was 145° C.

Production of Thermal Recording Material 8

A thermal recording material 8 was obtained in the same manner as in Example 1, except that the third thermal color-developing layer-coating liquid (VII) was used in place of the third thermal color-developing layer-coating liquid (III) in the production of the thermal recording material 1 of Example 1.

The eight thermal recording materials obtained above were subjected to smoothing treatment into a Bekk smoothness (JIS P 8119) of 1,200 to 1,500 seconds using a super calender by bringing the surface of each material on the thermal color-developing layer side into contact with the elastic roll.

Evaluation of Multicolor Thermal Recording Materials

The eight thermal recording materials of Examples 1 to and Comparative Examples 1 to 3 were evaluated in the following manner. The results were as shown in Table 1.

Evaluation of Developed Color

Using a thermal head (KPW-80-8TBB-1, produced by Kyocera Corporation; head resistance: 690Ω) of a thermal printing tester with a recording density of 8 dot/mm, solid printing consisting of 256 lines was performed at a constant applied voltage of 24 V under conditions for recording the single color 1, i.e., one-line recording time: 12.33 msec/line, sub-scanning line density: 8 lines/mm, applied energy per dot: 6.4 μJ/time, one pulse cycle: 98 μsec, and pulse repeating frequency: 109 to 124 times. Thus, the development of the single color 1 was recorded. The single applied energy per dot of one pulse is a value determined by the following formula: V×V/R×(pulse width). "V" represents the applied voltage (V), "R" represents the head resistance (52), and "pulse width" represents the time (μsec) of voltage application.

Solid printing consisting of 256 lines was performed at a constant applied voltage of 24 V under conditions for recording the mixed color 1, i.e., one-line recording time: 12.33 msec/line, sub-scanning line density: 8 lines/mm, applied energy per dot: 9.6 μJ/time, one pulse cycle: 102 μsec, and pulse repeating frequency: 110 to 120 times. Thus, the development of the mixed color 1 was recorded.

Solid printing consisting of 256 lines was performed at a constant applied voltage of 24 V under conditions for recording the mixed color 2, i.e., one-line recording time: 12.33 msec/line, sub-scanning line density: 8 lines/mm, applied energy per dot: 400.0 to 639.2 μJ/time, and pulse repeating frequency: 1 time. Thus, the development of the mixed color 2 was recorded.

Solid printing consisting of 256 lines was performed at a constant applied voltage of 24 V under conditions for recording the mixed color 3, i.e., one-line recording time: 12.33 msec/line, sub-scanning line density: 8 lines/mm, applied energy per dot: 63.9 μJ/time, one pulse cycle: 130 μsec, and pulse repeating frequency: 20 to 25 times. Thus, the development of the mixed color 3 was recorded.

The colors of the colored recording parts of the thus-obtained thermal recording materials were visually evaluated, and the coloring density of the yellow component (Y density), the coloring density of the cyan component (C density), and the coloring density (M density) of the magenta component were measured with a densitometer (X-Lite580).

TABLE 1

| | Single color 1 | Mixed color 1 | Mixed color 2 | Mixed color 3 |
|---|---|---|---|---|
| Example 1 | Yellow<br>C density: 0.06<br>M density: 0.13<br>Y density: 1.03 | Red<br>C density: 0.45<br>M density: 1.87<br>Y density: 1.71 | Blue<br>C density: 0.74<br>M density: 0.67<br>Y density: 0.42 | Black<br>C density: 1.45<br>M density: 1.44<br>Y density: 1.50 |
| Example 2 | Dark yellow<br>C density: 0.07<br>M density: 0.25<br>Y density: 1.27 | Red<br>C density: 0.43<br>M density: 1.82<br>Y density: 1.85 | Blue<br>C density: 0.71<br>M density: 0.63<br>Y density: 0.54 | Black<br>C density: 1.51<br>M density: 1.48<br>Y density: 1.58 |
| Example 3 | Yellow<br>C density: 0.06<br>M density: 0.13<br>Y density: 1.09 | Red<br>C density: 0.42<br>M density: 1.85<br>Y density: 1.68 | Reddish blue<br>C density: 0.76<br>M density: 0.78<br>Y density: 0.45 | Black<br>C density: 1.46<br>M density: 1.53<br>Y density: 1.52 |
| Example 4 | Dark yellow<br>C density: 0.07<br>M density: 0.23<br>Y density: 1.21 | Red<br>C density: 0.35<br>M density: 1.70<br>Y density: 1.68 | Dark blue<br>C density: 1.10<br>M density: 0.82<br>Y density: 0.52 | Black<br>C density: 1.55<br>M density: 1.58<br>Y density: 1.62 |
| Example 5 | Yellow<br>C density: 0.06<br>M density: 0.13<br>Y density: 1.05 | Red<br>C density: 0.48<br>M density: 1.79<br>Y density: 1.68 | Blue<br>C density: 0.72<br>M density: 0.65<br>Y density: 0.41 | Black<br>C density: 1.44<br>M density: 1.44<br>Y density: 1.48 |
| Comparative Example 1 | Yellow<br>C density: 0.03<br>M density: 0.21<br>Y density: 1.45 | Red<br>C density: 0.09<br>M density: 1.64<br>Y density: 1.33 | Nearly black dark green<br>C density: 0.81<br>M density: 0.78<br>Y density: 1.61 | Black<br>C density: 1.47<br>M density: 1.56<br>Y density: 1.67 |
| Comparative Example 2 | Red<br>C density: 0.18<br>M density: 1.95<br>Y density: 1.84 | Red<br>C density: 0.15<br>M density: 1.98<br>Y density: 1.79 | Purple<br>C density: 0.52<br>M density: 0.67<br>Y density: 0.37 | Black<br>C density: 1.01<br>M density: 1.21<br>Y density: 1.11 |
| Comparative Example 3 | Green<br>C density: 0.80<br>M density: 0.78<br>Y density: 1.06 | Black<br>C density: 1.30<br>M density: 1.20<br>Y density: 1.11 | Cyan<br>C density: 0.90<br>M density: 0.44<br>Y density: 0.38 | Black<br>C density: 1.25<br>M density: 1.20<br>Y density: 1.12 |

Table 1 reveals that in Examples 1 to 5 of the present invention, yellow was obtained as a single color from the layer capable of developing yellow in the single color 1, red was obtained as a mixed color from the layer capable of developing magenta and the layer capable of developing yellow in the mixed color 1, blue was obtained as a mixed color from the layer capable of developing cyan and the layer capable of developing magenta in the mixed color 2, and black was obtained as a mixed color from the layers capable of developing cyan, magenta, or yellow in the mixed color 3. In contrast, in the Comparative Examples, color separation properties are inferior, development of at least four colors is not obtained, and the desired color of yellow, blue, red, or black is not obtained.

REFERENCE SIGNS LIST

1. Multicolor thermal recording material
2. Support
3. First thermal color-developing layer
4. Intermediate layer
5. Second thermal color-developing layer
6. Third thermal color-developing layer

The invention claimed is:

1. A multicolor thermal recording material comprising:

(1) a support; and in order from a side close to the support, (2) a first thermal color-developing layer containing a first dye precursor and a color-developing compound reactive with the first dye precursor under heating to develop the color of the first dye precursor;

(3) an intermediate layer;

(4) a second thermal color-developing layer containing a particle component containing a second dye precursor, and a color-developing compound reactive with the second dye precursor under heating to develop the color of the second dye precursor; and (5) a third thermal color-developing layer containing a particle component containing a third dye precursor, and a color-developing compound reactive with the third dye precursor under heating to develop the color of the third dye precursor;

wherein the first, second, and third dye precursors are capable of developing mutually different colors, the second dye precursor-containing particle component contained in the second thermal color-developing layer comprises composite fine particles containing the second dye precursor and a polymeric compound, and the third dye precursor-containing particle component contained in the third thermal color-developing layer comprises composite fine particles containing the third dye precursor and a polymeric compound.

2. The multicolor thermal recording material according to claim 1, wherein the composite fine particles contained in the second and third thermal color-developing layers are each obtained by emulsifying and dispersing a liquid composition containing a polyvalent isocyanate compound and the second or third dye precursor in water, followed by polymerization of the polyvalent isocyanate compound.

3. The multicolor thermal recording material according to claim 1, wherein the first, second, and third thermal color-developing layers are capable of developing mutually different colors, and each is capable of developing yellow, magenta, or cyan.

4. The multicolor thermal recording material according to claim 3, which is capable of developing yellow, blue, red, or black.

5. The multicolor thermal recording material according to claim 3, wherein the dye precursor contained in the layer capable of developing yellow has a pyridine skeleton in its molecular structure.

6. A method for developing color of a multicolor thermal recording material, comprising the step of:

applying heat from a thermal head to a multicolor thermal recording material comprising:

(1) a support; and in order from a side close to the support, (2) a first thermal color-developing layer containing a first dye precursor and a color-developing compound reactive with the first dye precursor under heating to develop the color of the first dye precursor;

(3) an intermediate layer;

(4) a second thermal color-developing layer containing a particle component containing a second dye precursor, and a color-developing compound reactive with the second dye precursor under heating to develop the color of the second dye precursor; and (5) a third thermal color-developing layer containing a particle component containing a third dye precursor, and a color-developing compound reactive with the third dye precursor under heating to develop the color of the third dye precursor;

wherein the first, second, and third dye precursors are capable of developing mutually different colors, the second dye precursor-containing particle component contained in the second thermal color-developing layer comprises composite fine particles containing the second dye precursor and a polymeric compound, and the third dye precursor-containing particle component contained in the third thermal color-developing layer comprises composite fine particles containing the third dye precursor and a polymeric compound.

7. The method for developing color of a multicolor thermal recording material according to claim 6, wherein the first, second, and third thermal color-developing layers are capable of mutually different colors, and each is capable of developing yellow, magenta, or cyan.

8. The method for developing color of a multicolor thermal recording material according to claim 6, wherein the multicolor thermal recording material develops yellow, blue, red, or black.

9. The method for developing color of a multicolor thermal recording material according to claim 6, wherein:

the step of applying heat from the thermal head is conducted at one pulse width and pulse repeating frequency, and the method includes:

(1) applying a temperature lower than static color-development starting temperatures of the second and third thermal color-developing layers, and higher than a static color-development starting temperature of the first thermal color-developing layer, thereby developing the color of the first thermal color-developing layer;

(2) applying a temperature lower than the static color-development starting temperature of the third thermal color-developing layer, and higher than the static color-development starting temperature of the second thermal color-developing layer, thereby mixing colors developed from the first and second thermal color-developing layers;

(3) applying a temperature equal to or higher than the static color-development starting temperature of the third thermal color-developing layer, and prevent color development from the first thermal color-developing layer, thereby mixing colors developed from the second and third thermal color-developing layers; or (4) applying a temperature equal to or higher than the static color-development starting temperature of the third thermal color-developing layer, thereby developing the colors of the first, second, and third thermal color-developing layers.

* * * * *